US006557306B1

(12) United States Patent
Sekiya et al.

(10) Patent No.: US 6,557,306 B1
(45) Date of Patent: May 6, 2003

(54) ELEVATOR APPARATUS FOR USE IN A BUILDING HAVING A SEISMIC ISOLATION BUILDING PORTION AND A NON-SEISMIC ISOLATION BUILDING PORTION

(75) Inventors: Yuji Sekiya, Hitachinaka (JP); Masayuki Shigeta, Hitachinaka (JP); Sadanori Kuroda, Mito (JP)

(73) Assignees: Hitachi, Ltd., Tokyo (JP); Hitachi Mito Engineering Co., Ltd., Hitachinaka (JP)

( * ) Notice: Subject to any disclaimer, the term of this patent is extended or adjusted under 35 U.S.C. 154(b) by 0 days.

(21) Appl. No.: 09/648,615

(22) Filed: Aug. 28, 2000

(30) Foreign Application Priority Data

Dec. 21, 1999 (JP) ..... 11-363386

(51) Int. Cl.[7] ..... B66B 9/00

(52) U.S. Cl. ..... 52/30; 52/167.4; 52/167.8; 187/278

(58) Field of Search ..... 52/300, 27, 167.1, 52/167.4, 167.7, 167.8, 167.9; 187/278, 281

(56) References Cited

U.S. PATENT DOCUMENTS 5,036,955 A * 8/1991 Nakai et al. ..... 187/107
5,984,052 A * 11/1999 Cloux et al. ..... 187/404

FOREIGN PATENT DOCUMENTS

JP 11-130359 * 5/1999

* cited by examiner

*Primary Examiner*—Carl D. Friedman
*Assistant Examiner*—Yvonne M. Horton
(74) *Attorney, Agent, or Firm*—Antonelli, Terry, Stout & Kraus, LLP

(57) ABSTRACT

To provide sufficient clearance for an entrance part of an elevator hall facing a non-seismic isolation building portion, the partition wall on the entrance side may be removed and an expansion floor provided between the non-seismic isolation building portion entrance and the elevator shaft landing. A movable wall is provided between partition members located on the right and left sides of the elevator shaft. The expansion floor can move in the front and back directions with the partition members on the right and left sides as a guide. Furthermore, the wall moves with the elevator shaft independently in the right and left directions and follows the non-seismic isolation building movement.

12 Claims, 31 Drawing Sheets

USUAL TIME
( I - I LINE
SECTIONAL VIEW)

WHEN DISPLACEMENT
OCCURES
( II - II LINE
SECTIONAL VIEW,
PATTERN 1)

WHEN DISPLACEMENT
OCCURES
(III - III LINE
SECTIONAL VIEW,
PATTERN 2)

ELEVATOR APPARATUS FOR USE IN A BUILDING HAVING A SEISMIC ISOLATION BUILDING PORTION AND A NON-SEISMIC ISOLATION BUILDING PORTION

BACKGROUND OF THE INVENTION

The present invention relates to an elevator apparatus, especially of the type in which a car goes up and down in an internal elevator shaft which extends vertically through a non-seismic isolation building portion and a seismic isolation building portion of a building.

In Japanese Patent Laid-open No. 9-202562 bulletin, an elevator system is proposed for a building which has a non-seismic isolation building portion comprising plural stories and a seismic isolation building portion comprising plural stories installed through a seismic isolation means on the non-seismic isolation building portion. An elevator shaft for the elevator system extends internally through the seismic isolation building portion and downward through the non-seismic isolation building portion. The elevator system includes a car to go up and down in the elevator shaft from one floor to another, a landing structure at each floor for the elevator, a non-seismic isolation building portion entrance structure provided at the respective floors of the non-seismic isolation building portion to face the elevator shaft landing, and a expansion member provided at an entrance of the non-seismic isolation building portion and at a position facing the elevator shaft landing and provided to cover a clearance which is designed to absorb an earthquake motion so as to permit to relative displacement due to an earthquake motion between the non-seismic isolation building portion and the seismic isolation building portion.

As shown in Japanese Patent Laid-open No. 9-202562 bulletin, an elevator system has been proposed for use in a building which has a non-seismic isolation building portion of plural stories, a seismic isolation building portion of plural stories installed through a seismic isolation means on the non-seismic isolation building portion, and an elevator shaft which is provided in the building and extends from the top to the bottom thereof. The elevator shaft system includes a car to go between floors through the elevator shaft from the top to the bottom, the elevator shaft supporting framework to connect a shaft structure formed in the non-seismic isolation building portion to a shaft structure formed in the seismic isolation building portion and to support a guide rail for the car which extends the full length of the non-seismic isolation building portion and the seismic isolation building portion, a frame for a floor door installed so as to be displaced or to incline according to a relative displacement between the non-seismic isolation building portion and the seismic isolation building portion, and an expansion member provided to face the floor door and span across a clearance which is provided so as to accommodate a displacement in the shaft supporting framework during an earthquake.

SUMMARY OF THE INVENTION

In an elevator apparatus supported in an elevator shaft which is provided so as to extend vertically in a seismic isolation building, an expansion floor is provided which spans a clearance that is provided between the seismic isolation building portion and the non-seismic isolation building portion in order to absorb earthquake motion. At an entrance part of the elevator hall facing the non-seismic isolation building portion, it is necessary to provide an expansion floor between the non-seismic isolation building portion entrance and the elevator shaft landing, and, in this regard, a big clearance is necessary for the entrance facing the non-seismic isolation building portion.

In an elevator apparatus which operates in an elevator shaft provided in a seismic isolation building to access floors from top to bottom, there is provided a shaft supporting framework to support a rail on which the elevator car travels to each floor of the seismic isolation building, and frame of the floor door is installed in the shaft supporting framework to provide a passage in the entrance to allow access to the elevator car. However, a big clearance is needed at the entrance supported by the shaft supporting framework.

Accordingly, an object of the present invention is to make the clearance large that can be utilized at the entrance part of the elevator hall of the non-seismic isolation building portion and the entrance part of the grade installing the elevator shaft supporting framework.

In order to achieve the object mentioned above, the present invention provides an elevator apparatus for use in a building having a non-seismic isolation building portion of at least one story, a seismic isolation building portion installed through seismic isolation means on the non-seismic isolation building portion, an elevator shaft extending from top to bottom through the non-seismic isolation building portion and the seismic isolation building portion and having a structure which disposed with a clearance with at least one of the non-seismic isolation building portion and the seismic isolation building portion so as to accommodate a relative transfer/displacement between the elevator shaft structure and the building portion structure. The elevator apparatus includes a car that can move up and down between floors along the path formed by the elevator shaft structure. The elevator shaft structure includes an elevator shaft landing formed at each entrance to the elevator shaft on each floor, and an expansion floor provided at the clearance between an edge part of a floor of the non-seismic isolation building portion and a landing of the elevator shaft, making it possible to accommodate relative transfer/displacement therebetween in response to an earthquake motion.

The elevator apparatus is characterized by a movable wall provided between partition members which are located on both sides of the landing of the non-seismic isolation building portion, which is able to relatively move with the partition members when being swung in right and left directions, and is able to relatively move with the elevator shaft structure when being swung in front and back directions, being bigger than the width of the landing of the elevator shaft structure.

DETAILED DESCRIPTION OF THE PREFERRED EMBODIMENTS

An embodiment of the present invention will be explained with reference to FIGS. 1 to 15.

Figure 1:
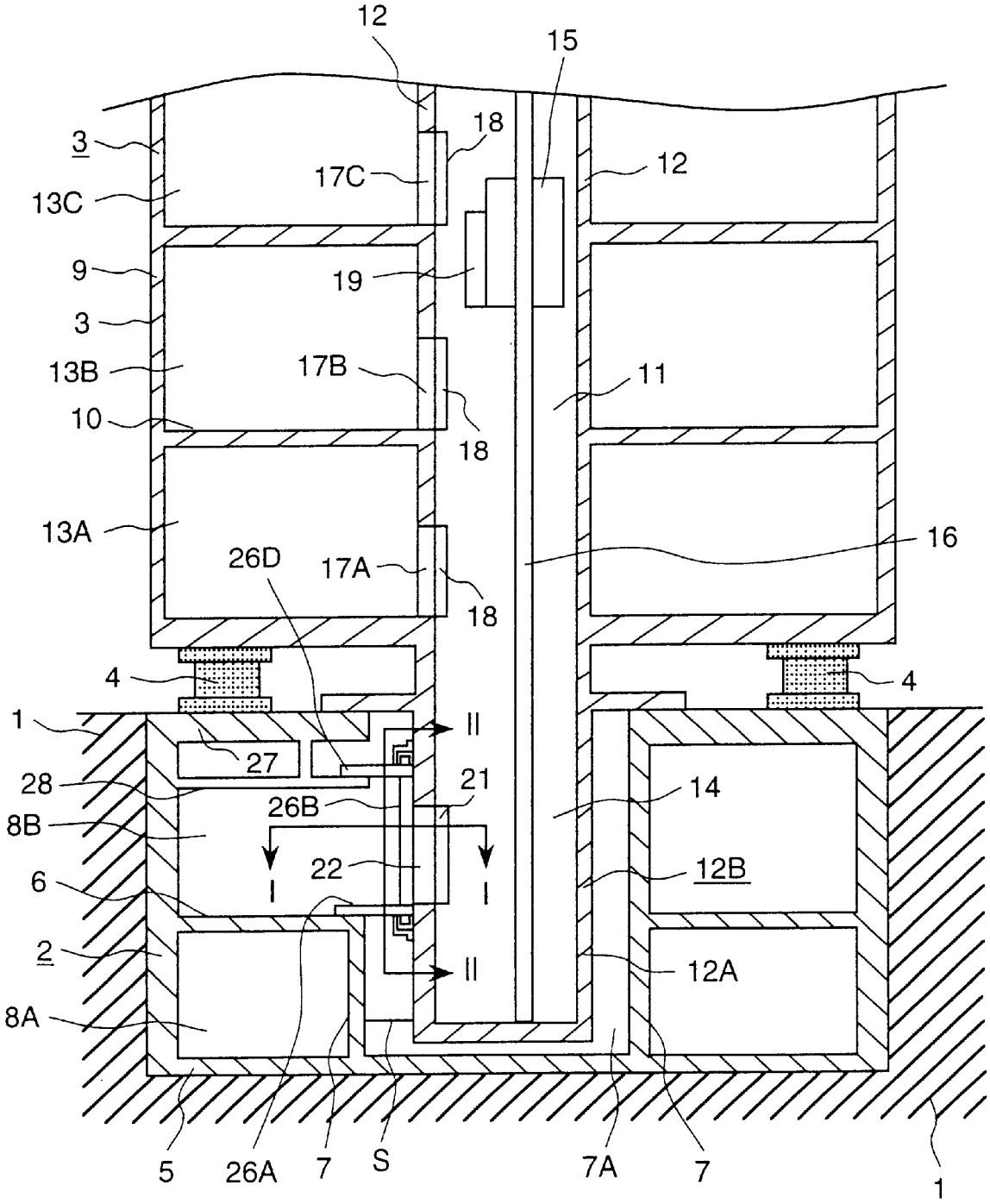
FIG. 1 is a longitudinal section of an elevator apparatus representing one embodiment of the present invention.

FIG. 1 is a longitudinal sectional view of an elevator apparatus representing an embodiment of the present invention, which elevator apparatus is installed in a building having a non-seismic isolation building portion 2 installed directly in the ground 1 and a seismic isolation building portion 3 that is installed as upper stories on top of the non-seismic isolation building portion 2.

The seismic isolation building portion 3 is mounted on plural seismic isolation devices 4, which are supported on the non-seismic isolation building portion 2. A seismic isolation device 4 made with an elastic body, as generally known, is provided between the non-seismic isolation building portion 2 and the seismic isolation building portion 3. When an earthquake occurs, if the non-seismic isolation building portion 2 is directly provided on the ground 1 as a base, the seismic isolation building portion 3 is restrained relative to the earthquake motion by the seismic isolation devices 4.

The non-seismic isolation building portion 2 has a partition wall 7 provided in order to create inside spaces, defined by an outside wall 5 and a floor 6, to provide plural spaces 8A, 8B as rooms. Only two floors or stories are shown as an example in the non-seismic isolation building portion 2, however, a floor or floors above the second story may be provided.

The seismic isolation building portion 3 has an inside wall 12, an outside wall 9, and a plurality of floors 10, which define an elevator shaft 11 for an elevator apparatus and plural spaces 13A, 13B, 13C to be used as rooms.

The elevator shaft 11 extends vertically from a top story to a bottom story along the center of the seismic isolation building portion 2, and a car 15 of the elevator apparatus is mounted therein to go up and down between floors. In the lower part of the elevator shaft 11, a lower shaft portion 14 is provided to allow the car 15 to service the floors of the non-seismic isolation building portion 2.

This lower shaft portion 14 extends to the floors of the lower stories and is defined by the structure 12B formed by a lower partition wall 12A which extends below the seismic isolation devices 4. This lower structure 12B is located so as to maintain a clearance 7A with the partition wall 7 inside of the non-seismic isolation building portion 2. This clearance absorbs an earthquake motion and is needed to accommodate transfer/displacement of the shaft structure 12B relative to the non-seismic isolation building portion 2. The elevator car 15 in the seismic isolation building portion 3 moves up and down inside of the elevator shaft which is constituted by the lower stories shaft portion 14 and the upper stories shaft portion 11.

In FIG. 1, the lower stories shaft structure 12B is formed with the seismic isolation building portion 3 as one body, and is formed by using a building material which is the same as that used in the seismic isolation building portion 3, however, the lower stories shaft structure 12B may be formed independently and may be joined together with the seismic isolation building portion 3 as one body by using features, such as bolts, etc.

In the embodiment shown in FIG. 1, the shaft structure which forms the upper stories shaft portion 11 and the lower stories shaft portion 14, is constituted by the walls 12A, 12. However, this structure may be constituted with a beam which extends vertically and a lateral beam (supporting frame) which extends laterally. The lower stories shaft portion 14 is surrounded at the circumference thereof with the lower partition wall 12A in the same way as the upper stories shaft portion 11, so that a person outside the shaft can not touch the car 15 as it goes up and down in the lower stories shaft portion 14. When a structure of the shaft portion 14 is adopted which poses a danger that a person may be able to touch the car 15, an extra protection should be provided so that a person is not able to touch the car 15. Furthermore, a building structure should be employed in which no person is able to come close to the upper stories shaft portion 11 or the lower stories shaft portion 14.

The car 15 of the elevator goes up and down in the upper stories shaft portion 11 and the lower stories shaft portion 14. Inside of the upper stories shaft portion 11 and the lower stories shaft portion 14, a guide rail 16 extends in a vertical direction, and the car 15 goes up and down along this guide rail 16.

The rooms 13A, 13B, 13C of respective stories of the seismic isolation building portion 3 are provided with landing parts 17A, 17B, 17C through which the elevator services the upper stories along the shaft portion 11. The elevator landing parts 17A, 17B, 17C are arranged in the inside wall 12 of the shaft structure forming the upper stories shaft portion 11. On these elevator landing parts 17A, 17B, 17C, an entrance door 18 is arranged to communicate with the upper stories shaft portion 11. In correspondence with the position of the entrance door 18, a car door 19 is provided on car 15 to permit access to the car when the car stops at a particular floor.

The rooms 13A, 13B, 13C of the seismic isolation building portion 3 are disposed adjacent to the upper stories shaft portion 11, being separated therefrom by the inside wall 12. On the contrary, the partition wall 7 which forms rooms 8A, 8B in the non-seismic isolation building portion 2 and the inside wall 12A which forms the lower stories shaft portion 14 are provided separately so that they may be displaced independently, and the partition wall 7 and the inside wall 12A are arranged so as to maintain a predetermined clearance S therebetween.

That is to say, the elevator shaft portion of the seismic isolation building portion 3, which is installed through the seismic isolation devices 4 on the upper part of the non-seismic isolation building portion 2, is constructed differently from the elevator shaft portion of the non-seismic isolating building portion 2. The structure which constitutes the lower stories shaft portion 14 provides a space 7A between the shaft wall 12A and the adjacent room wall 7 so as to maintain a predetermined clearance S therebetween in the non-seismic isolation building portion 2.

As a result of the above-described construction, the seismic isolation building portion 3 and the non-seismic isolation building portion 2 are subject to individual earthquake motions when an earthquake occurs. This is the result of provision of the clearance S, which serves to absorb the earthquake motion and to permit a relative displacement between the non-seismic isolation building portion 2 and the seismic isolation building portion 3. One part of the shaft structure 12B extending in a vertical direction inside of the seismic isolation building portion 3 and the non-seismic isolation building portion 2 maintains a clearance S relative to the non-seismic isolation building portion 2, so that relative transfer/displacement becomes possible when the building is subjected to a earthquake motion. Usually, in an earthquake, the seismic isolation building portion 3 will swing with the same displacement from the top to the lower part of the whole building without bending the top of the building.

Since a clearance S is provided between the inside wall 12A, which forms the lower stories shaft portion 14 and the non-seismic isolation building portion 2, and the inner wall 7 of the rooms on each floor, an expansion floor 26A is installed in the non-seismic isolation building portion 2 with the elevator landing part 22 having the entrance door 21 for the person getting on and off the elevator.

Here, the elevator shaft structure forming the upper stories shaft portion 11 and the lower stories shaft portion 14 is fixedly supported on the seismic isolation building portion 3 in FIG. 1, and the lower part of the shaft structure has a clearance S with the inner wall 7 of the non-seismic isolation building portion 2; however, in accordance with the present invention, a reverse construction may be applied easily. That is, in the case where the shaft structure is fixedly supported on the non-seismic isolation building portion 2, and the upper part of the shaft structure has a clearance S with the inner wall of the seismic isolation building portion 3, the advantages of the present invention can be achieved in the same way.

Figure 2:
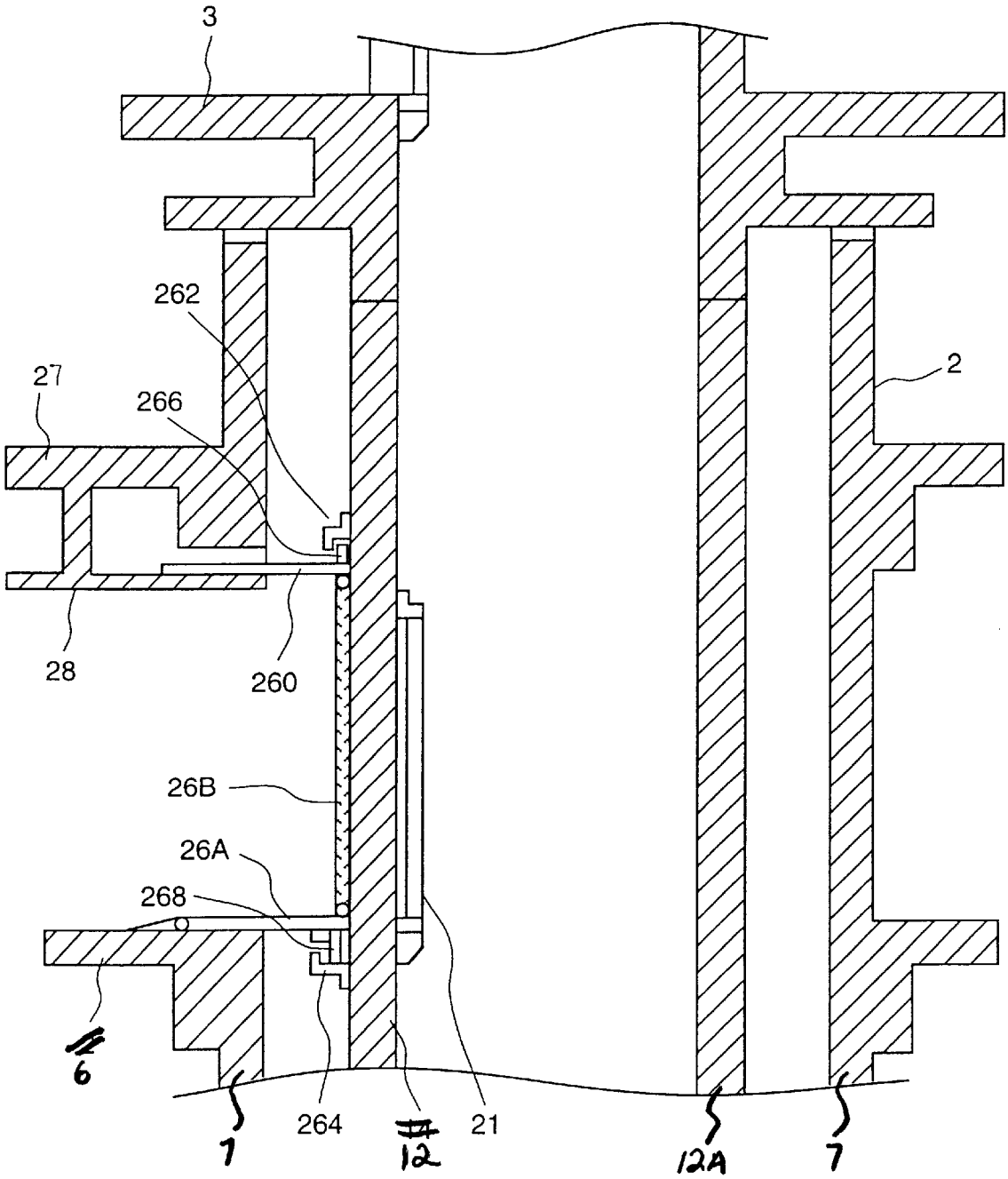
FIG. 2 is a longitudinal section of a non-seismic isolation building side entrance part of FIG. 1, and it shows a normal state when there is not a relative displacement between top and bottom buildings.
Figure 5:
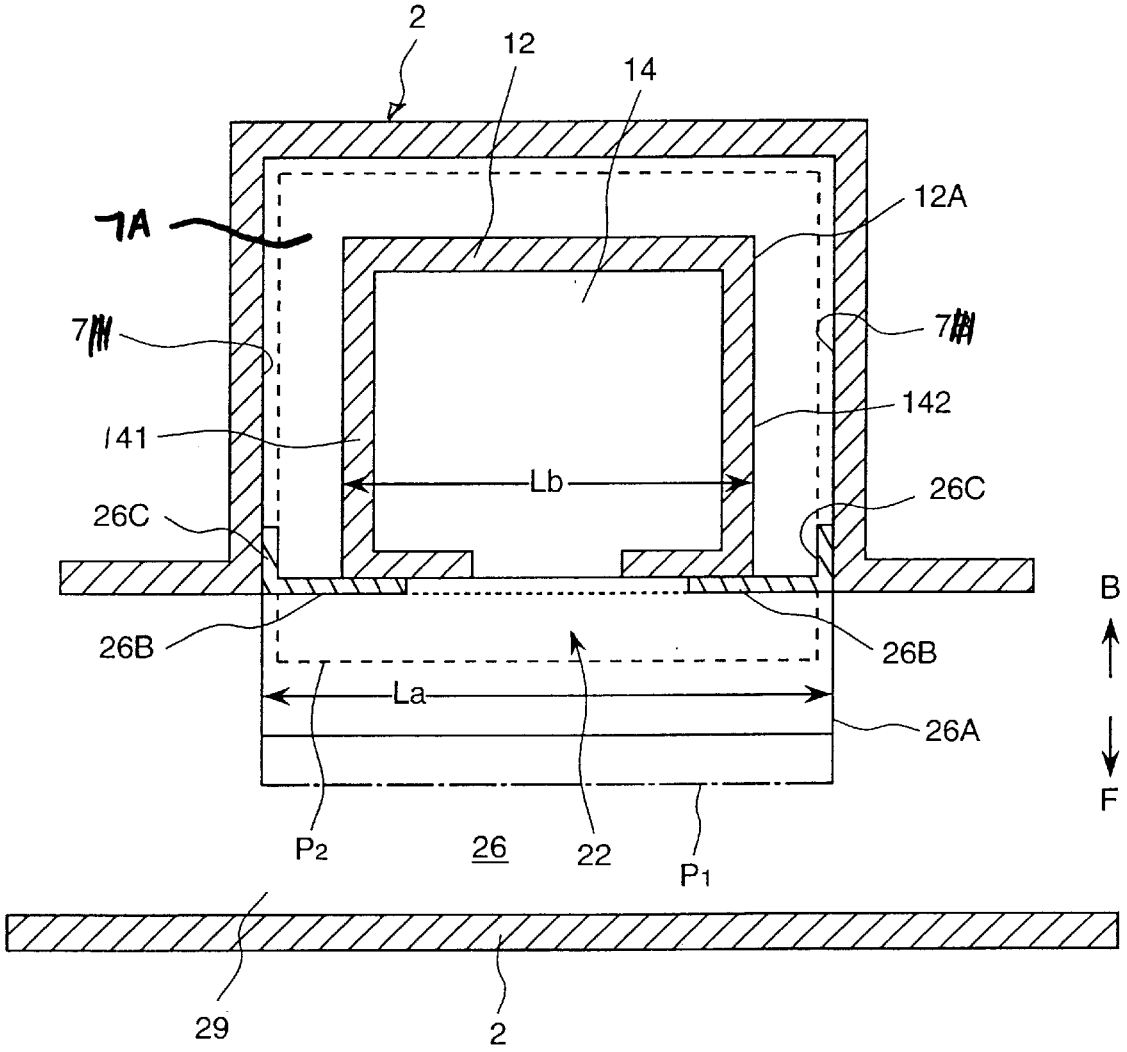
FIG. 5 is a sectional view taken along a line I—I of FIG. 1, and it shows a normal state when there is not a relative displacement between top and bottom buildings.
Figure 6:
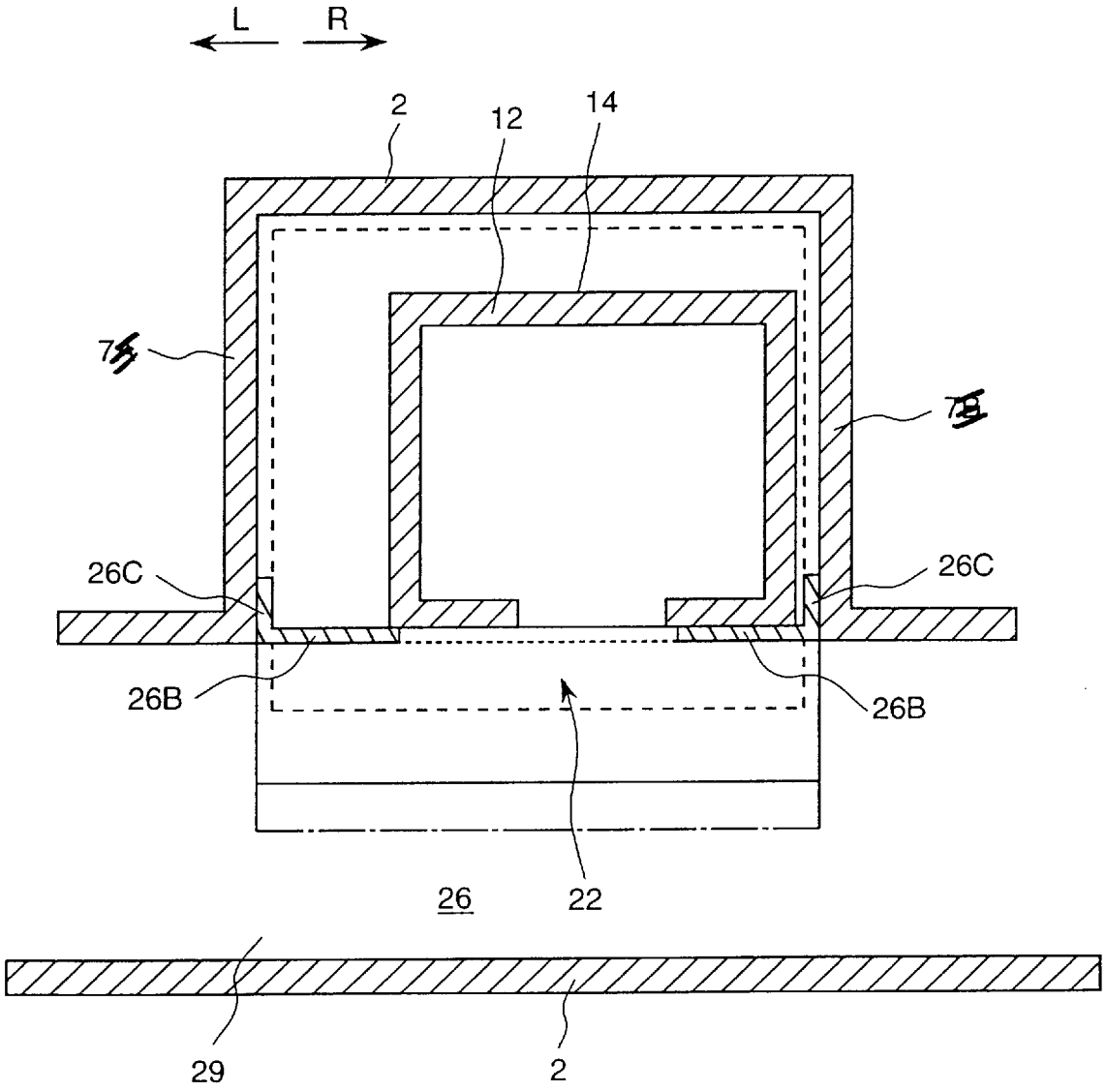
FIG. 6 is a sectional view taken along a line I—I of FIG. 1, and it shows a state when a displacement outbreaks in right and left directions (pattern 1).
Figure 7:
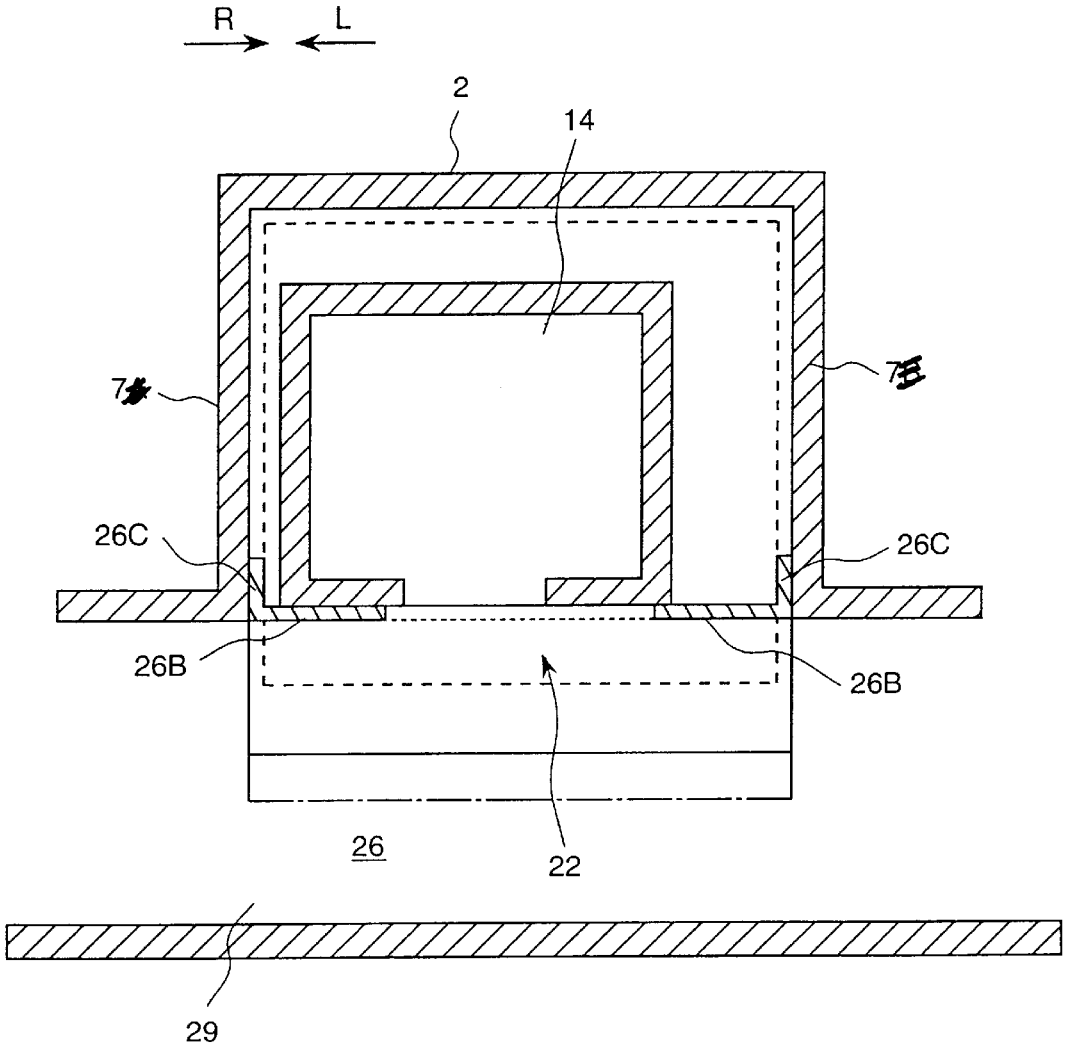
FIG. 7 is a sectional view taken along a line I—I of FIG. 1, and it shows a state when a displacement outbreaks in right and left directions (pattern 2).

As shown in FIG. 5, which is a sectional view taken along a line I—I of FIG. 1, and as seen in FIG. 2, which is a detailed longitudinal sectional view of the landing part of the non-seismic isolation building portion 2, the expansion floor 26A extends from an elevator landing 22, and spreads in right and left directions beyond the shaft walls of 141, 142 in a width direction of the lower stories shaft portion 14 (a frontage direction) until reaching the partition wall 7, and spans the space between the inside wall 12A forming the lower stories shaft portion 14 of the front part of the elevator landing part 22 and the inner wall 7 of the non-seismic isolation building portion 2. Accordingly, it is possible for a passenger to pass on the expansion floor 26A into and out of the car 15. The length La of the expansion floor 26A is longer than the width Lb of the landing side surface of the shaft structure 12B, as shown in Figure, so that the platform space can be broader.

Figure 10:
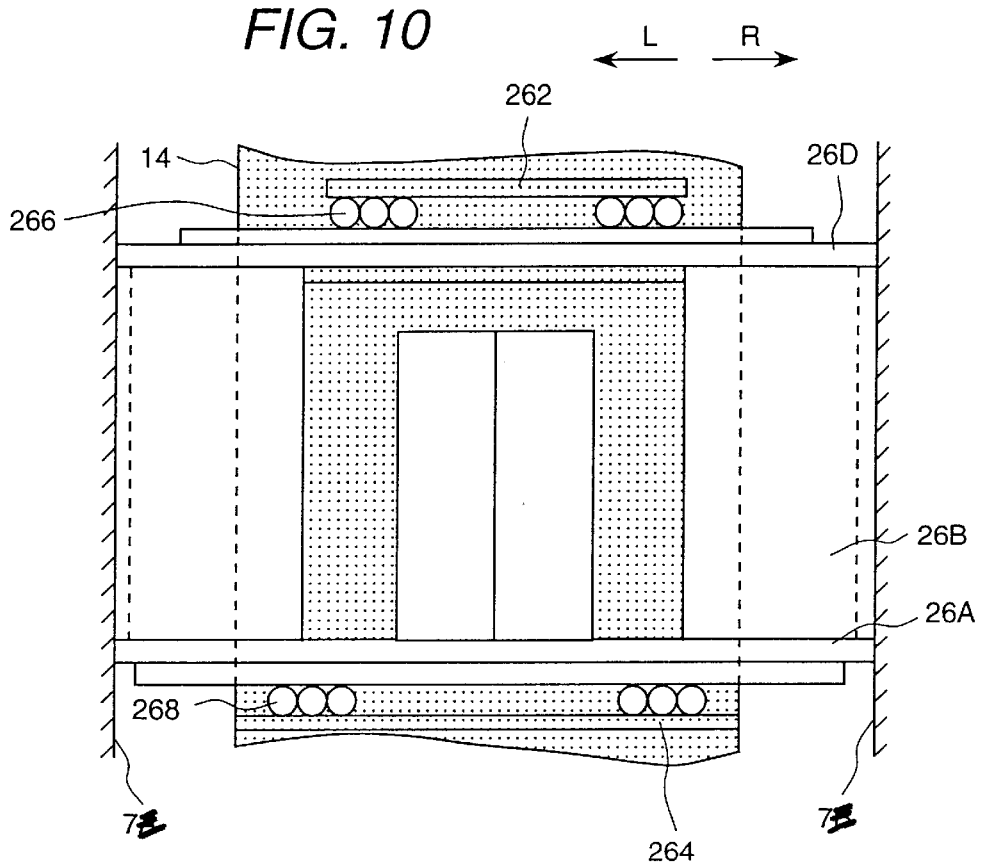
FIG. 10 is a sectional view taken along a line II—II of FIG. 1.
Figure 11:
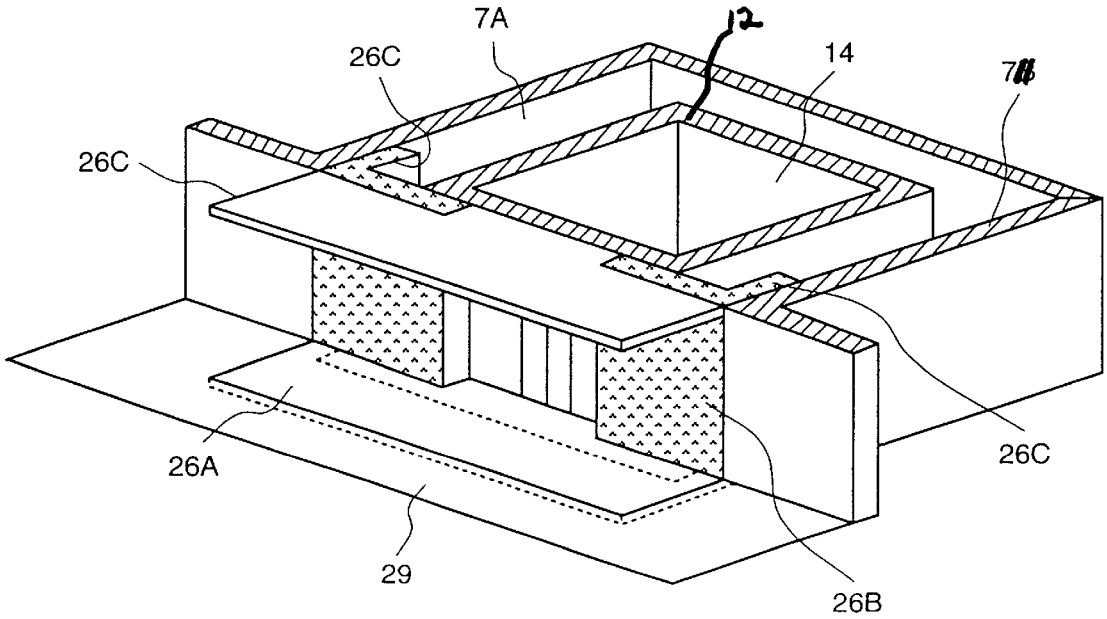
FIG. 11 is a perspective view of the entrance part of the non-seismic isolation building side at a normal time in FIG. 1.
Figure 12:
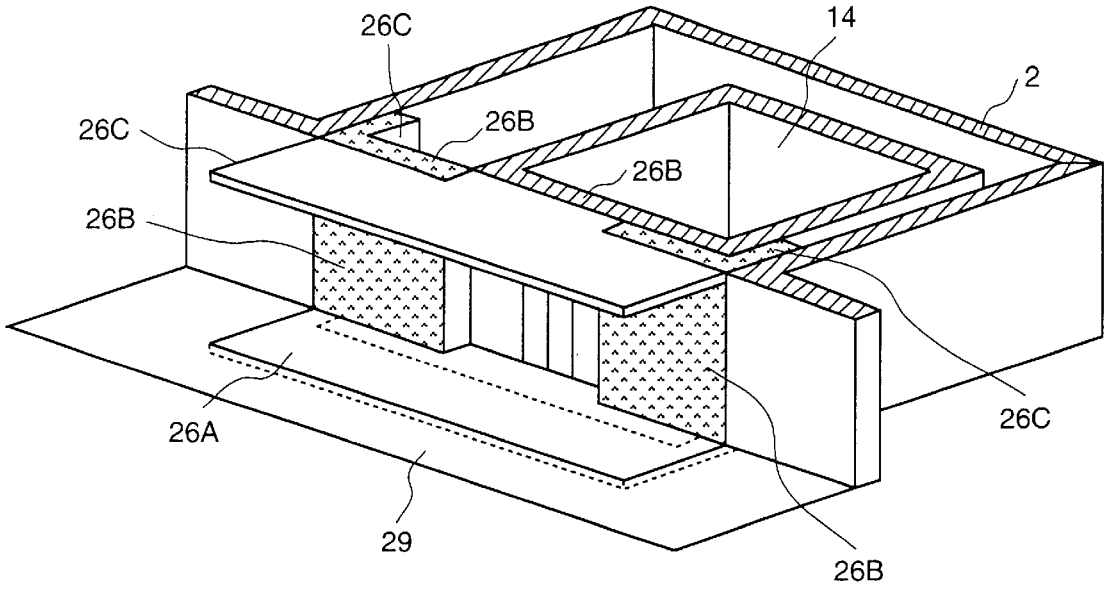
FIG. 12 is a perspective view of the entrance part of the non-seismic isolation building side, which shows a state when a displacement outbreaks in the right and left directions in FIG. 1.
Figure 13:
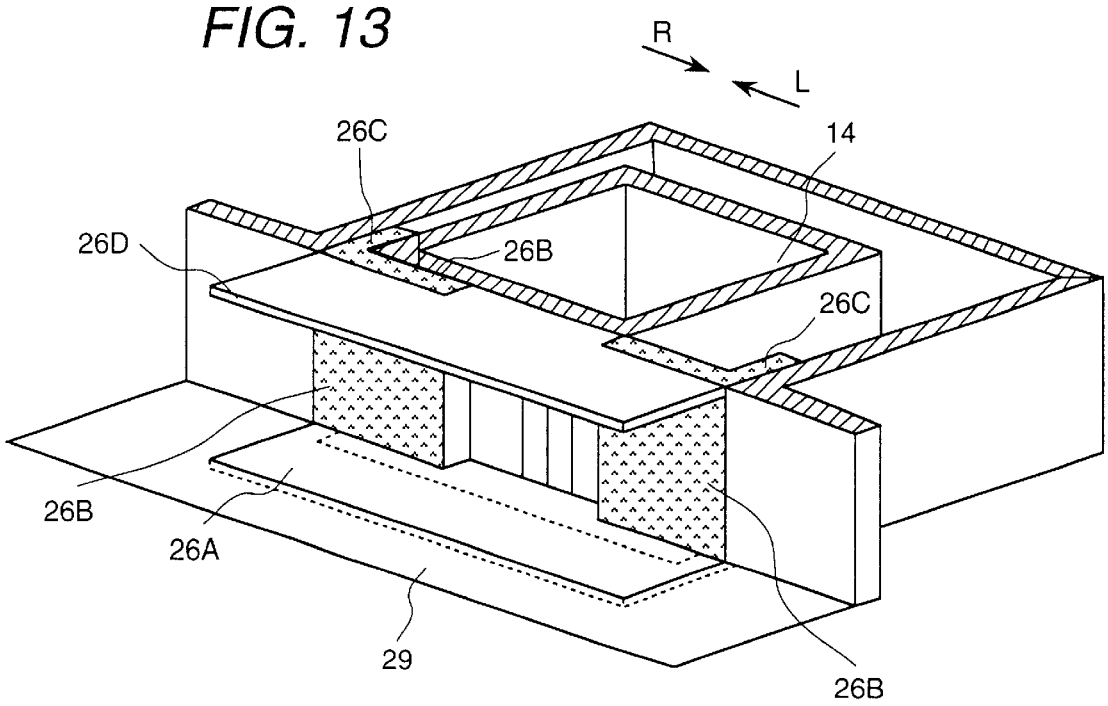
FIG. 13 is a perspective view of the entrance part of the non-seismic isolation building side, which shows a state when a displacement outbreaks in the right and left directions in FIG. 1.

As shown in FIG. 10, which is a sectional view taken along a line II—II of FIG. 1, this expansion floor 26A is supported on the seismic isolation building portion 3 so as to be able to move in forward and backward directions F, B relative to the non-seismic isolation building portion 2 and to be able to follow movement of the partition wall 7 in right and left directions R, L.

In FIG. 5, a dashed line P2 shows the position of an edge of the floor of the non-seismic isolation building portion 2, and the expansion floor 26A is supported on the edge of the floor. The edge of the floor of the non-seismic isolation building portion 2 moves to the front direction to a position shown by an alternate long and short dash line P1 in response to earthquake motion.

A lower stories elevator shaft side of the expansion floor 26A facing the lower stories elevator shaft is supported by the structure of the lower stories shaft portion 14 so that the expansion floor 26A is able to relatively move/displace in right and left directions relative to the lower stories shaft portion 14. Moreover, in the lower stories elevator shaft side of the expansion floor 26A, a movable wall 26B of the building is provided so as to extend in an up and down direction up to a ceiling. This movable wall 26B of the building extends to the partition wall 7 in right and left directions in the same way as the expansion floor 26A, and has a function to partition off an elevator landing 22 of the non-seismic isolation building portion 2 from the structure of the non-seismic isolation building portion 2 and provides a clearance between the non-seismic isolation building portion and the seismic isolation building portion. In the partition walls 7 respectively provided on the right and left sides of this movable wall 26B, a movable side wall 26C mentioned later is provided.

Attached to the upper part of this movable wall 26B of the building, a slidable ceiling 26D extending to the partition wall 7 to the right and the left is provided in order to close the clearance S in the same manner as the expansion floor 26A. A ceiling 28 is suspended from the ceiling 27 in the room 8B of the non-seismic isolation building portion 2, and this slidable ceiling 26D may be supported on the ceiling 28. However, in that case, a construction which will prevent the slidable ceiling 26D from hanging down should be provided.

The expansion floor 26A, the movable wall 26B, and the slidable ceiling 26D may be separately supported in each of the lower stories shaft portion 14. In that case, to the right and left direction, they must be supported on the structure of the lower stories elevator shaft.

The expansion member 26 is formed by the expansion floor 26A, the movable wall 26B of the building and the slidable ceiling 26D, and it may be moved in front and back directions relative to the structure of the non-seismic isolation building portion 2 by using the partition wall 7 in the right and left directions as a guide. In addition, it may be moved in right and left directions relative to the lower stories shaft portion 14. When a relative displacement has occurred between the non-seismic isolation building portion 2 and the seismic isolation building portion 3 by an earthquake, it is possible to relatively transfer/displace movements in the right and left or the front and the back directions.

Figure 3:
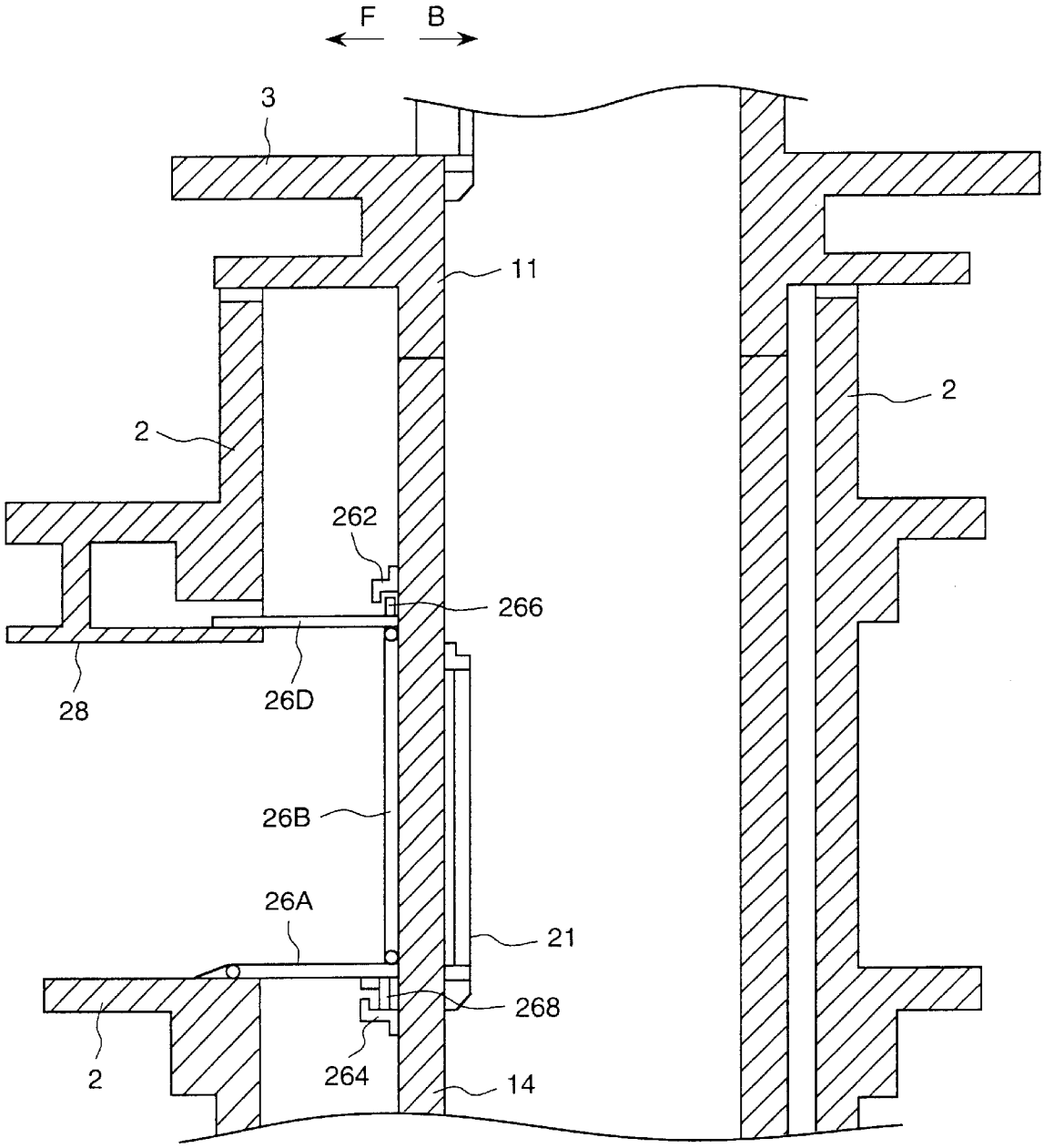
FIG. 3 is a longitudinal section of a non-seismic isolation building side entrance part, which shows a state when a displacement outbreaks in front and back directions (pattern 1) in FIG. 2.
Figure 4:
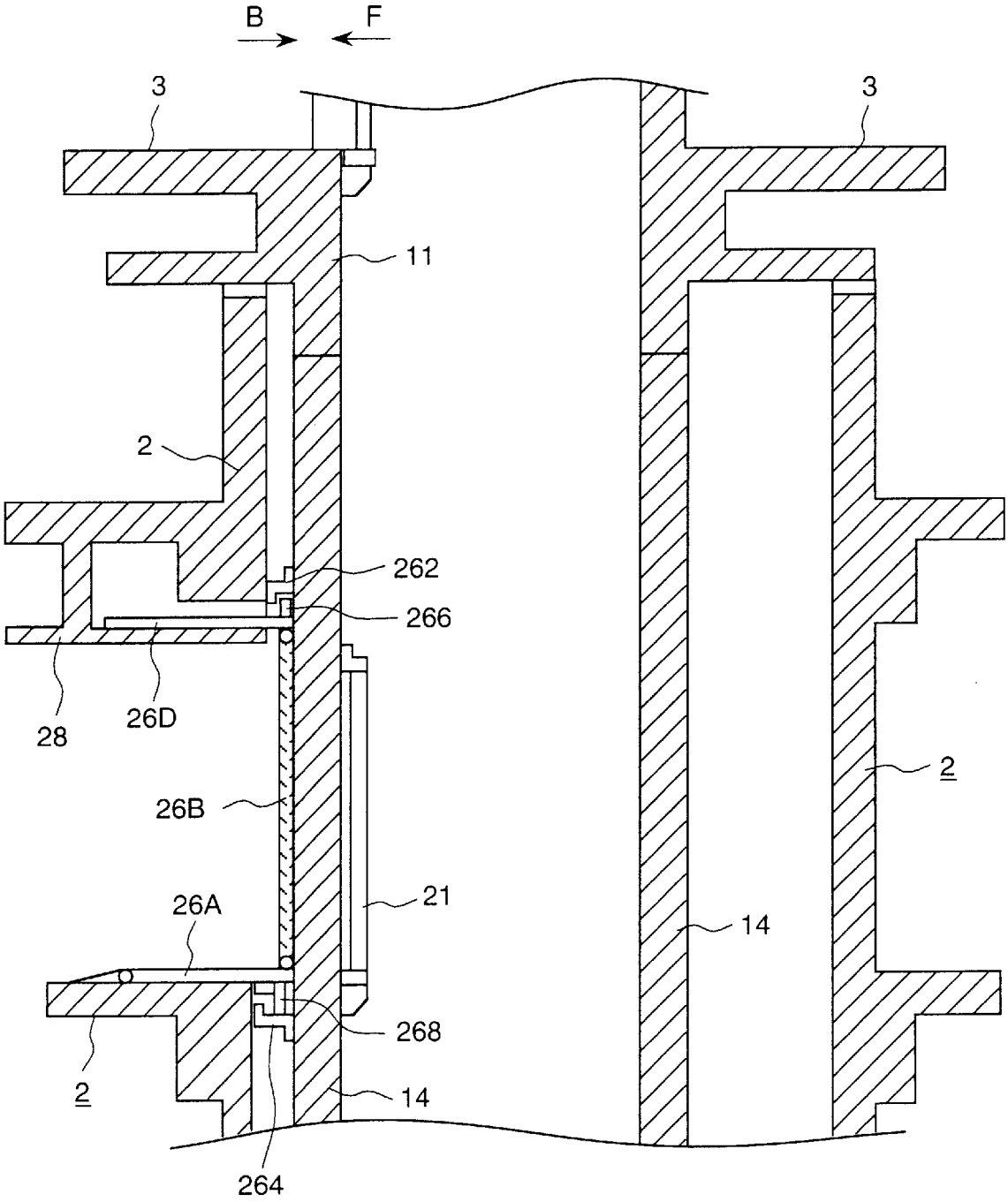
FIG. 4 is a longitudinal section of a non-seismic isolation building side entrance part, which shows a state when a displacement outbreaks in front and back directions (pattern 2) in FIG. 2.
Figure 8:
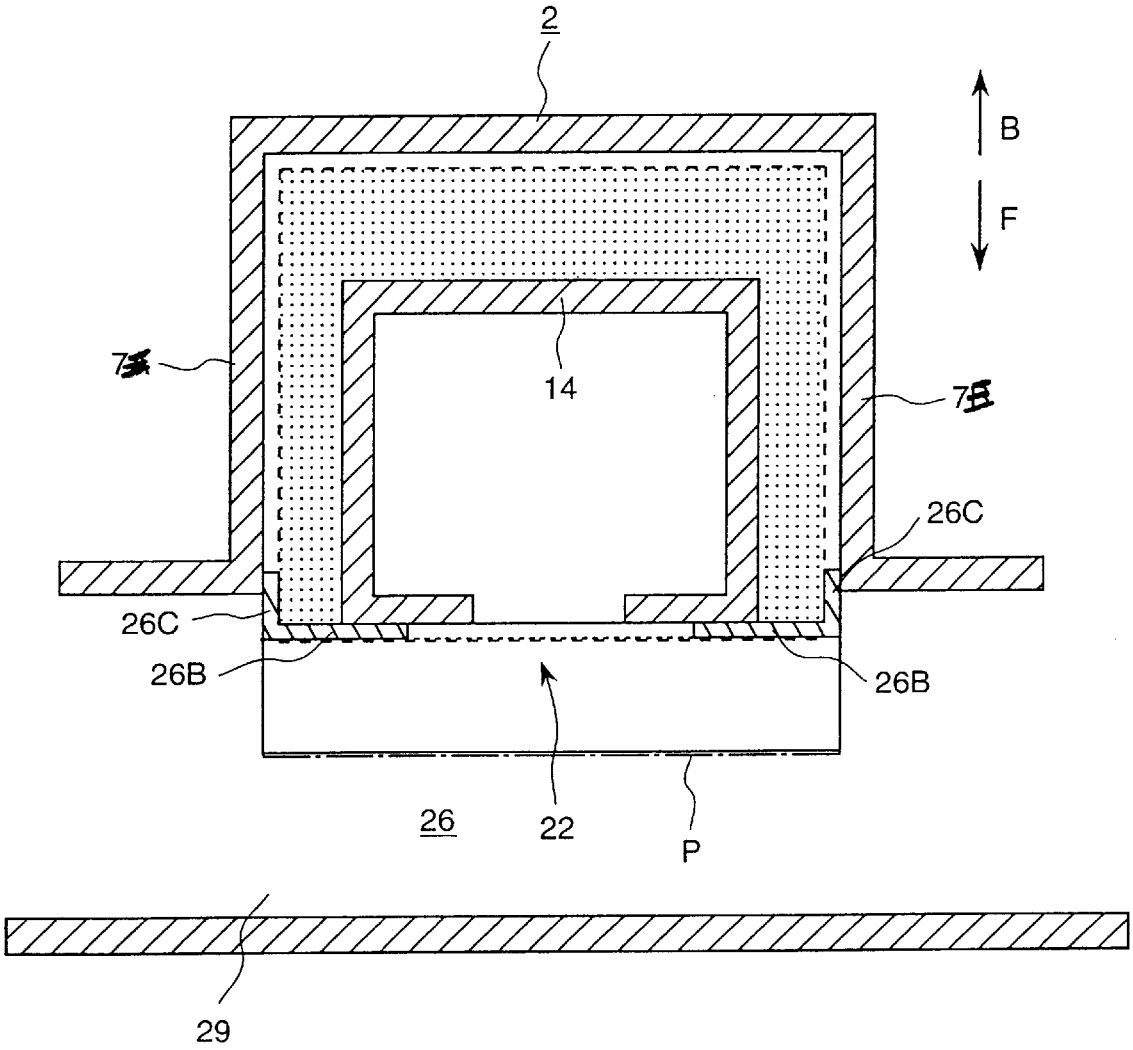
FIG. 8 is a sectional view taken along a line I—I of FIG. 1, and it shows a state when a displacement outbreaks in front and back directions (pattern 1).
Figure 9:
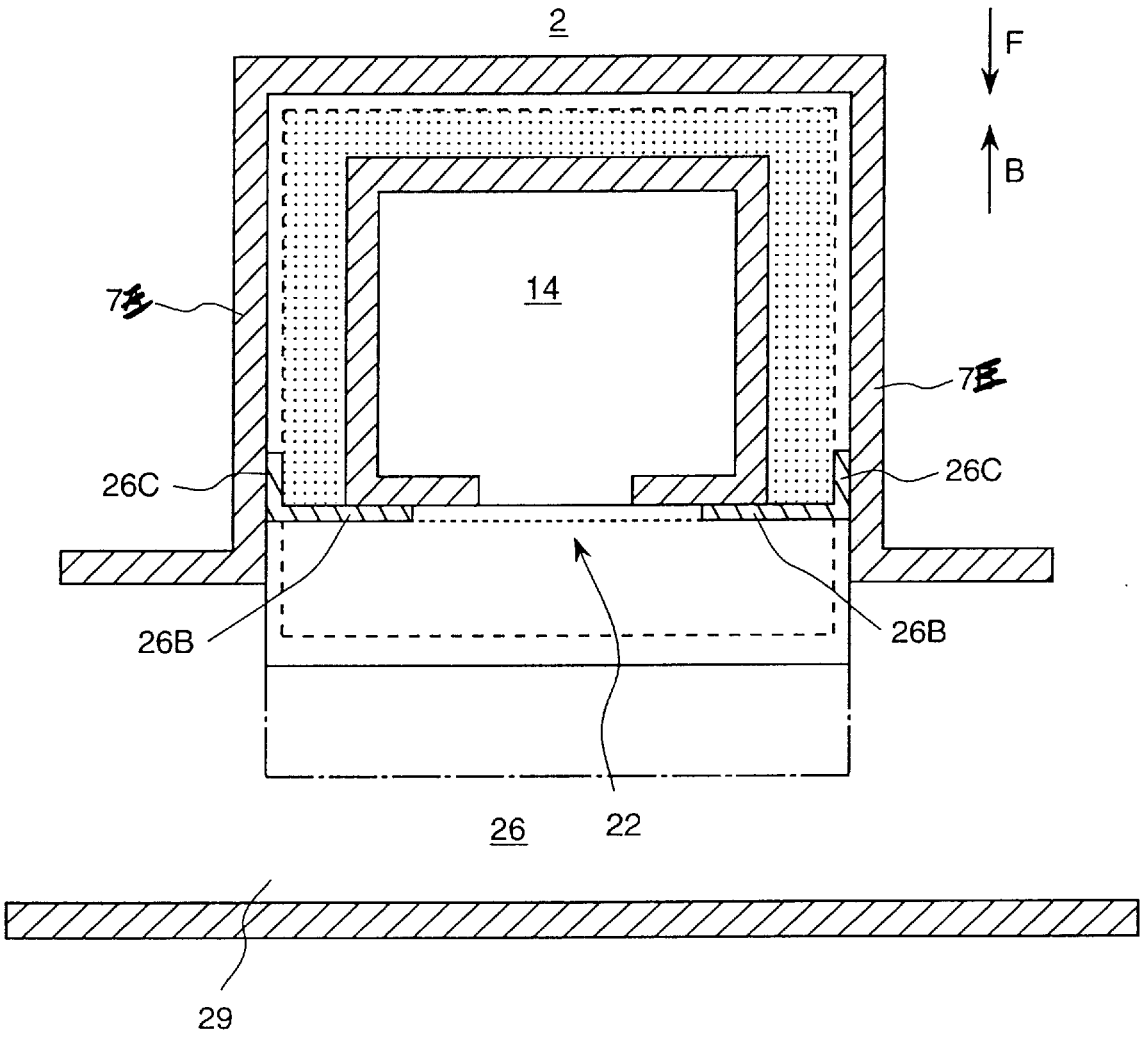
FIG. 9 is a sectional view taken along a line I—I of FIG. 1, and it shows a state when a displacement outbreaks in front and back directions (pattern 1).
Figure 14:
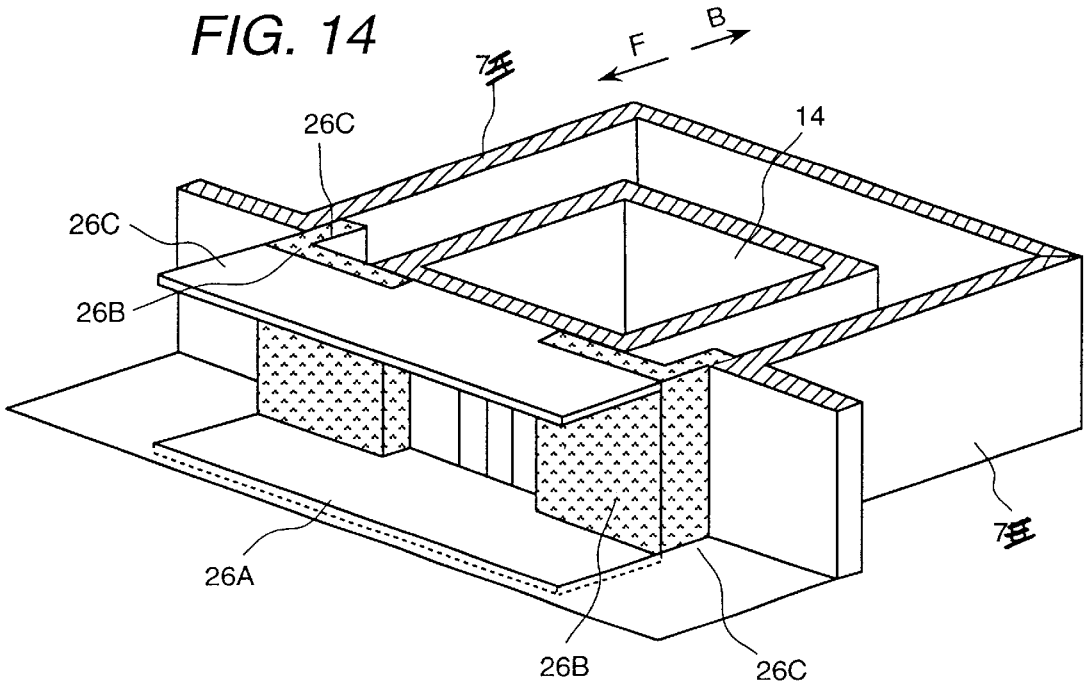
FIG. 14 is a perspective view of the entrance part of the non-seismic isolation building side, which shows a state when a displacement outbreaks in the front and back directions in FIG. 1.
Figure 15:
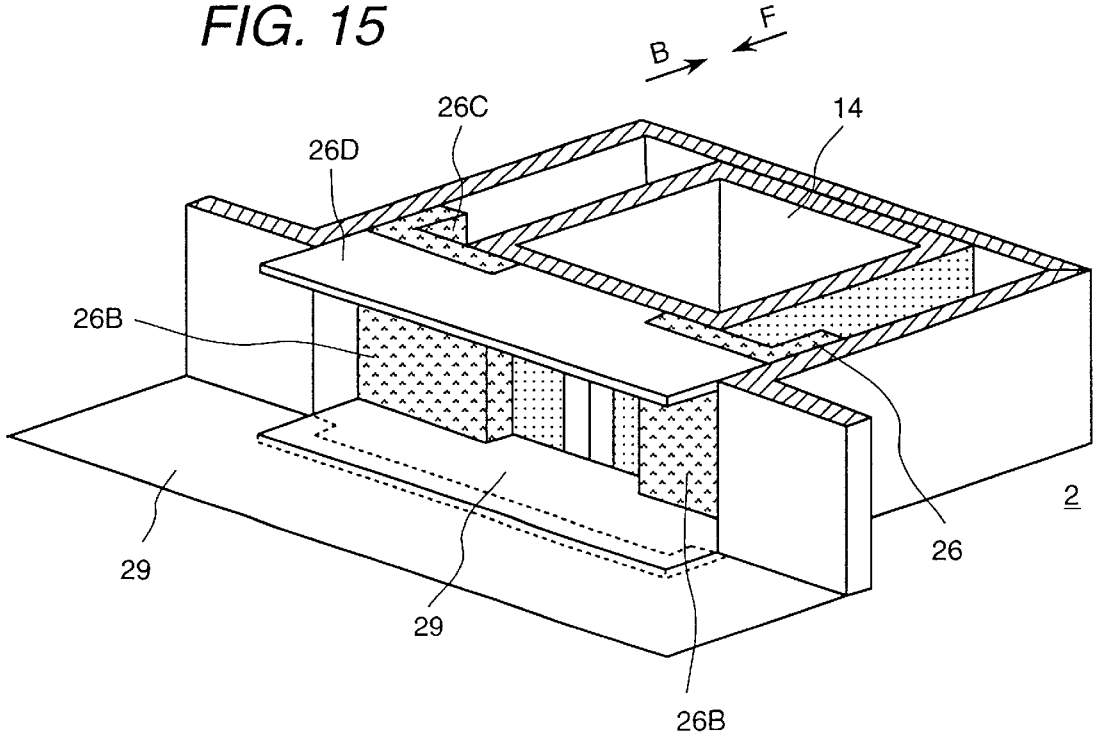
FIG. 15 is a perspective view of the entrance part of the non-seismic isolation building side, which shows a state when a displacement outbreaks in the front and back directions in FIG. 1.

FIG. 10 shows details of the structural arrangement in the neighborhood of the expansion floor 26A, and is a sectional view taken along a line II—II in FIG. 1. When an earthquake motion has occurred, the upper and lower guides 266, 268 sliding to the right and left direction by rolling on expansion member supporting brackets 262, 264, which are fixed to the lower stories shaft portion 14 side, and the expansion floor 26A, the movable wall 26B, and the slidable ceiling 26D are supported by the upper part guide 266 and the lower part guide 268. When an earthquake motion has occurred, the expansion floor 26A and the movable wall 26B slide in front and back directions relative to the structure of the lower stories shaft portion 14, and can move/displace relatively and freely. FIGS. 3, 8, 14 show a case in which the building is displaced in a direction such that the clearance S of platform becomes bigger, and FIGS. 4, 9, 15 show a case in which the building is displaced in a direction such that the clearance S of the platform closes. FIGS. 6, 12, and FIGS. 7, 13 show a case in which the non-seismic isolation building portion 2 relatively moves in right and left directions relative to the seismic isolation building portion 3.

The edge of the partition wall 7 located on the right and left of the non-seismic isolation building portion 2, facing the elevator hall 29, extends to the surface of the movable wall 26B facing the elevator hall 29, as shown in FIG. 5; however, when the expansion member 26 moves to a front side relative to the non-seismic isolation building portion 2 due to an earthquake, the movable wall 26B of the building moves beyond the surface of the partition wall 7 on the right and left facing the elevator hall 29, as shown in FIG. 8.

When moving beyond the surface, the edge of the movable wall 26B facing the partition wall 7 can be seen from the elevator hall side. This is because, as the thickness of the movable wall 26B of the building is small, it is blocked by the movable side wall 26C (auxiliary member) which is in parallel with the partition wall 7 and extends to the opposite side relative to the elevator hall, so that even if the relative displacement exceeds the thickness of the movable wall 26B of the building, the clearance S can be partitioned off from the non-seismic isolation building portion 2. This movable side wall 26C works as a guide member to guide the movable wall 26B of the building in movements in front and back directions F, B along the partition wall 7 and even if the movable wall 26B of the building moves to the front in response to an earthquake motion, the movable side wall 26C maintains contact with the partition wall 7 and does not separate from it, as shown in FIG. 8.

In addition, although not illustrated in the figure, which the edge of the partition wall 7 located at right and left sides of the non-seismic isolation building portion 2, facing to the elevator hall 29, extends to the same surface as the surface of the movable wall 26B facing the elevator hall, it may be extended to a position which does not exceed the clearance provided between said non-seismic isolation building portion and the seismic isolation building portion. Thereby, it becomes easy to guide the partition wall 26B, and difficult for the movable wall 26B to deviate from the partition wall 7, however, on the other hand, an unnecessary obstacle may be created on the platform. Accordingly, it is better for the extended part to be as small as possible.

In addition, as shown in FIG. 9, when the expansion member 26 moves toward the back relative to the non-seismic isolation building portion 2 due to an earthquake (or the non-seismic isolation building portion 2 moves back), the movable wall 26B of the building moves back from an end surface of the partition wall 7 in the right and left sides facing the elevator hall; and, when the relative displacement between the seismic isolation building portion 3 and the non-seismic isolation building portion 2 becomes zero, the movable wall 26B of the building moves back to the same surface with the side surface of the partition wall 7 provided on the right and left sides facing the elevator hall 29.

Figure 27:
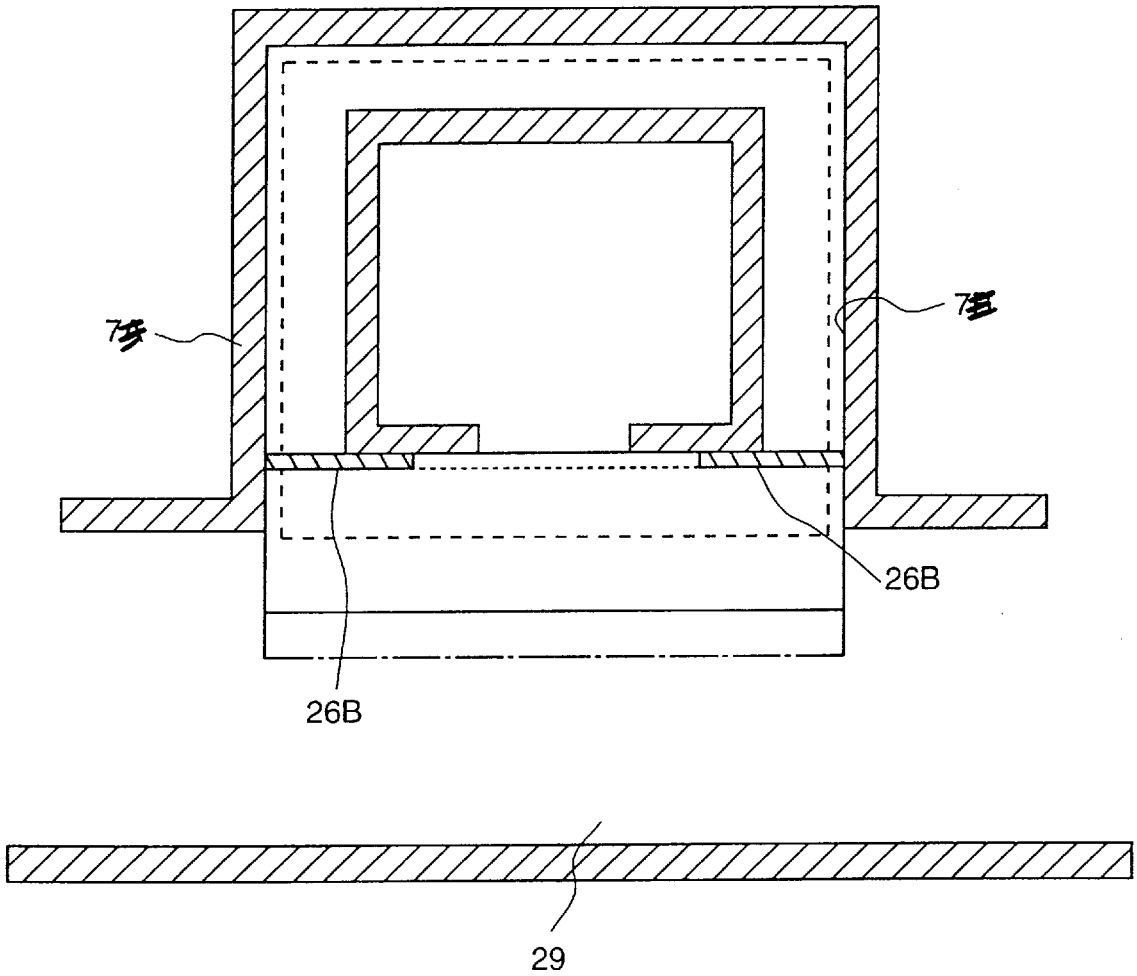
FIG. 27 is a sectional view showing another embodiment of the present invention.
Figure 28:
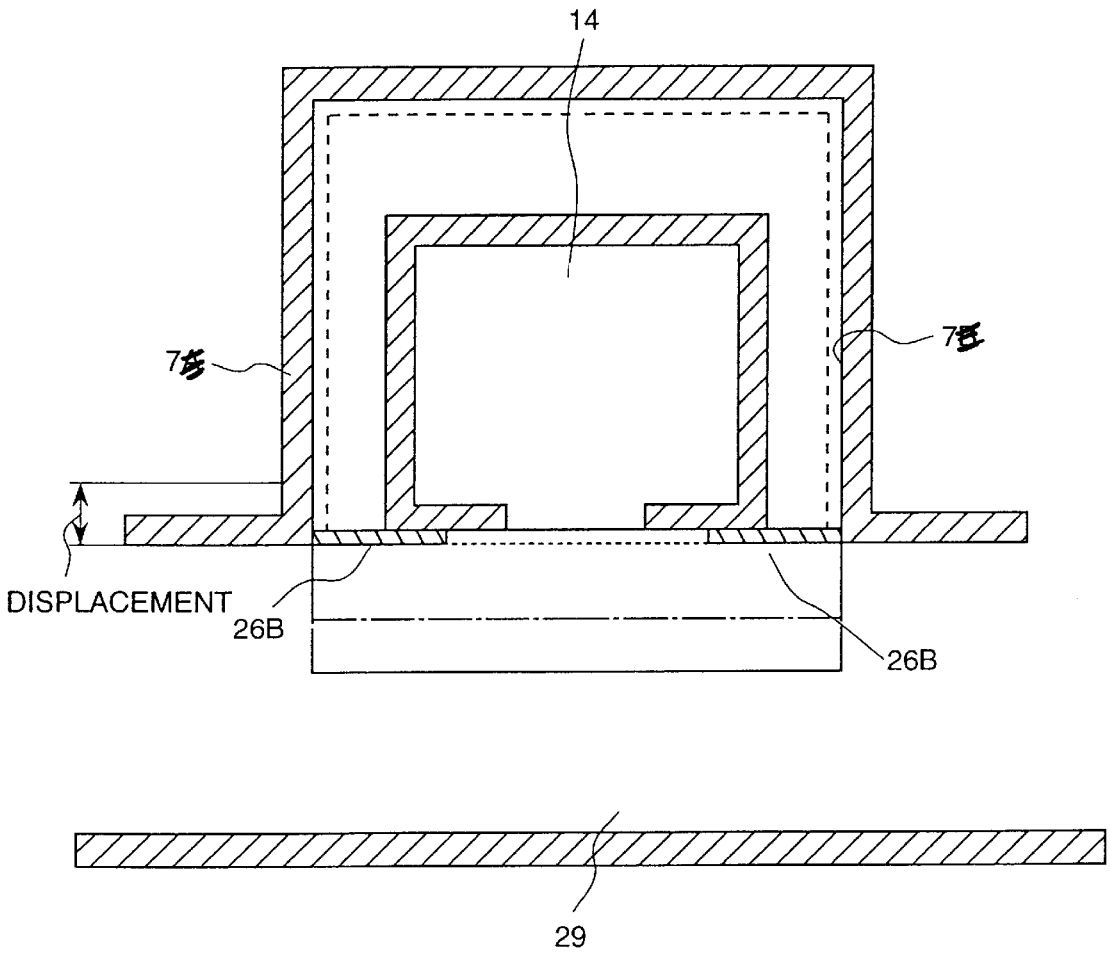
FIG. 28 is a sectional view of a positional relationship when the greatest displacement has occurred in the front direction in FIG. 27.
Figure 29:
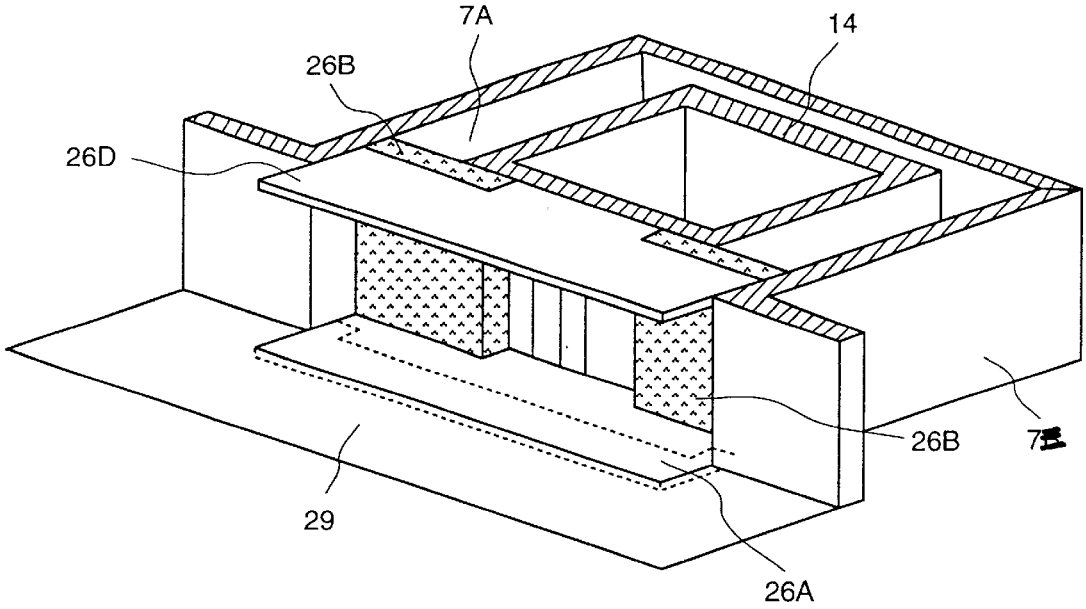
FIG. 29 is a detailed perspective view of the structure of FIG. 27.
Figure 30:
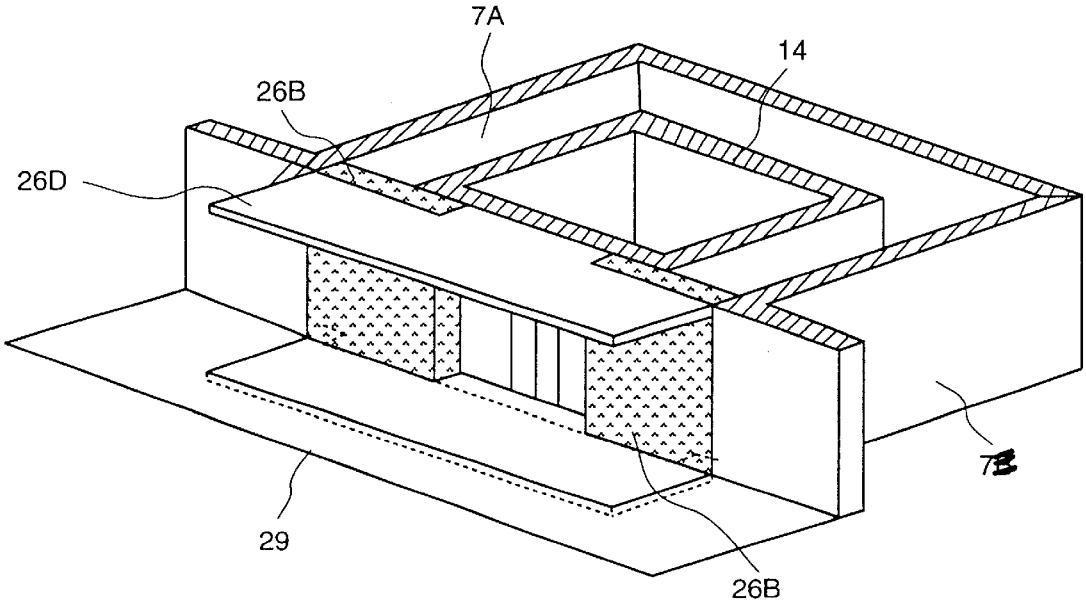
FIG. 30 is a perspective view showing a state when the displacement in the front direction becomes the greatest in FIG. 29.

Regarding the side surface of the partition wall 7 provided on the right and left sides facing the elevator hall 29, as to the amount that the movable wall 26B moves out, as shown in FIG. 9, the end surface of the partition wall 7 provided on the right and left sides facing the elevator hall 29 may be extended out previously. In that case, as the movable walls 26B facing the partition wall 7 move toward the front from the surface of the partition wall 7 provided on the right and left sides facing the elevator hall 29, there is no need to provide the movable side wall 26C, as shown in FIGS. 27, 29. In such a case, FIGS. 28, 30 are respectively a cross sectional view and a perspective view showing a state in which a maximum displacement occur in a forward direction.

According to the above constitution, since the end surface of the partition wall 7 on the right and left sides facing the elevator hall do not extend out of the same surface with the surface of the movable wall 26B facing the elevator hall, it becomes possible to make the clearance that can be utilized larger. If the end surface of the partition wall 7 on the right and left sides facing the elevator hall is extended, the movable wall of the building can be guided sufficiently in the region having the clearance, and a large platform space can be obtained.

Figure 33:
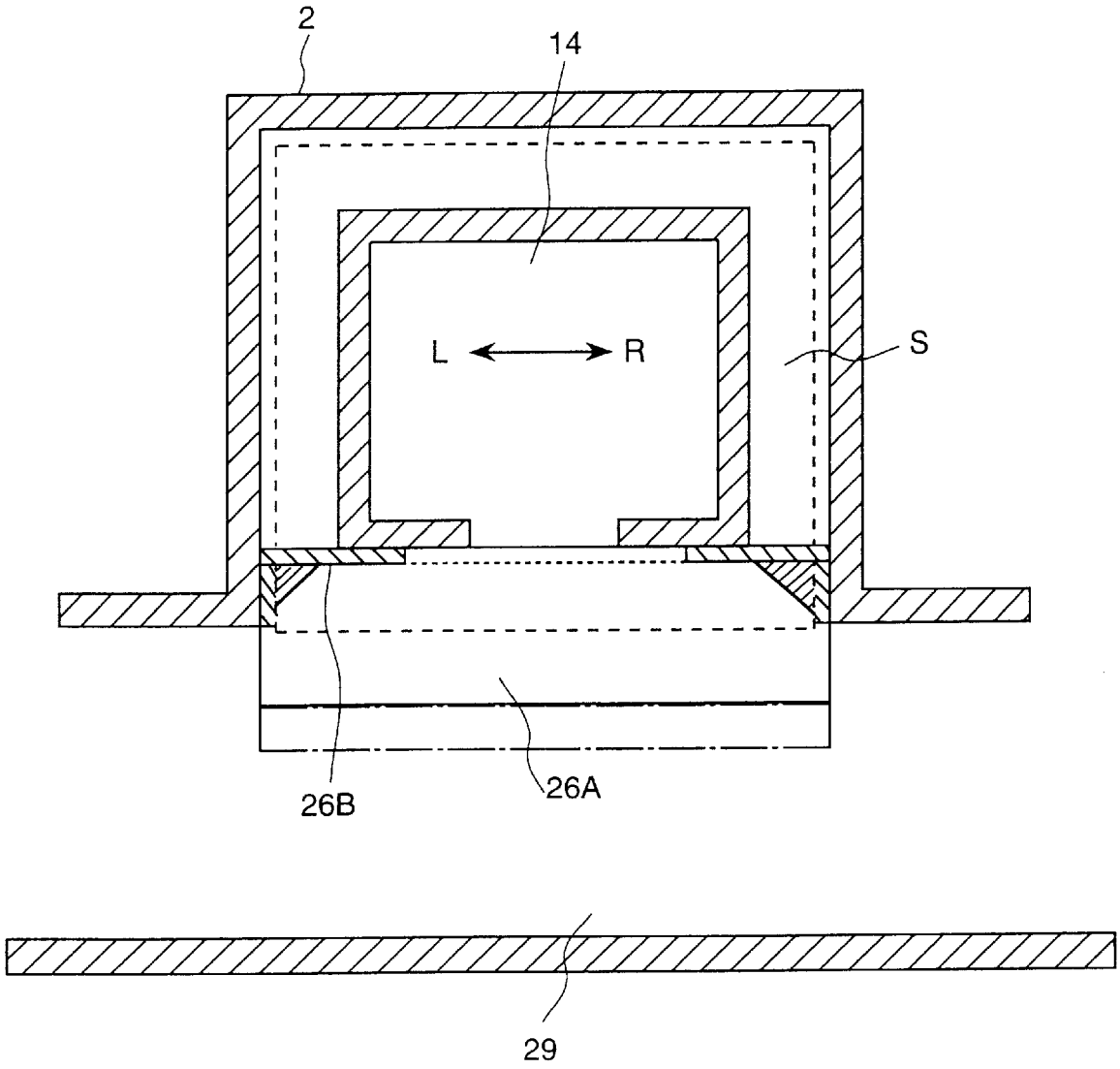
FIG. 33 is a sectional view showing another embodiment in the present invention.
Figure 34:
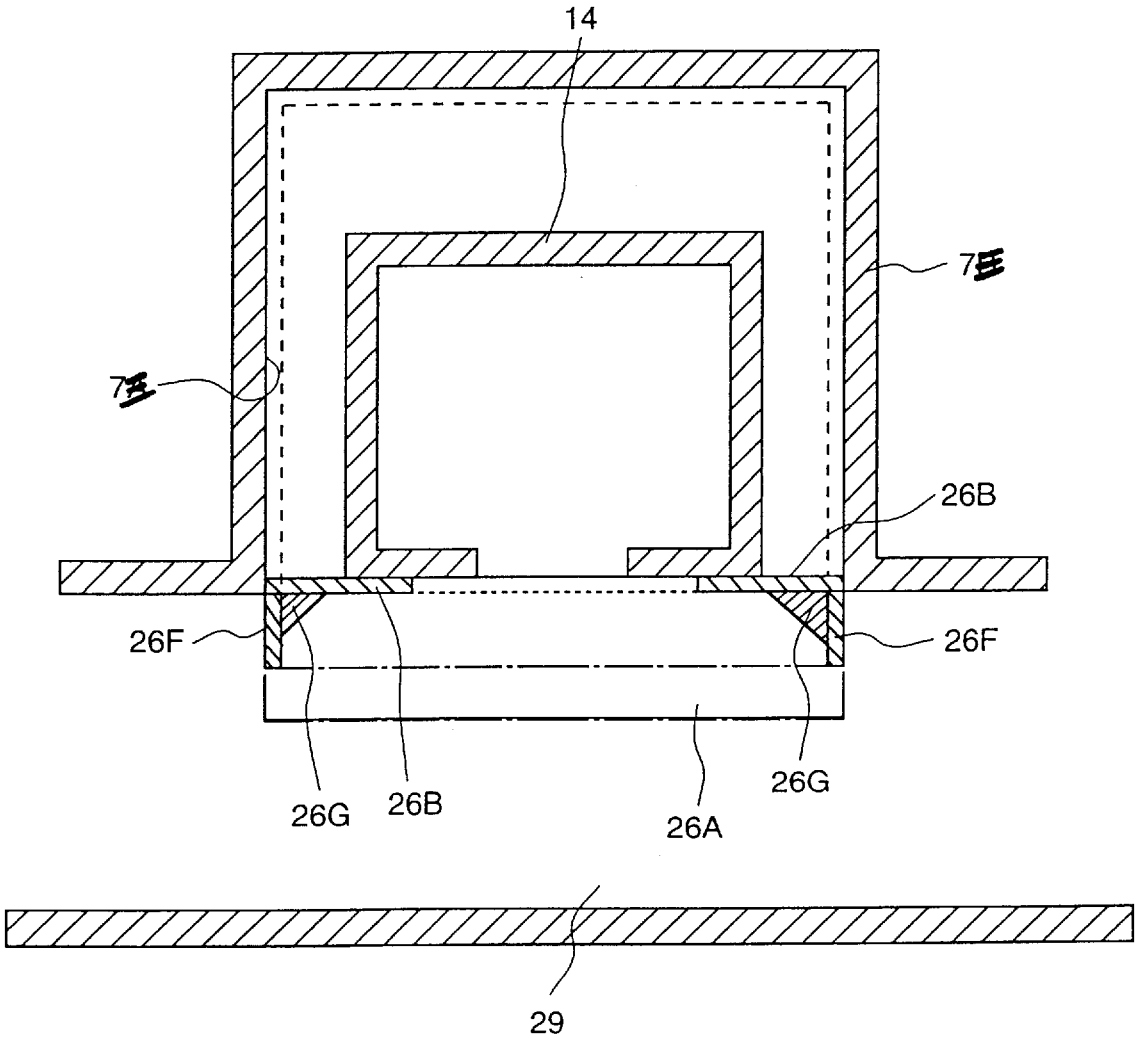
FIG. 34 is a sectional view showing a state when a displacement in the front direction has occurred FIG. 33.
Figure 35:
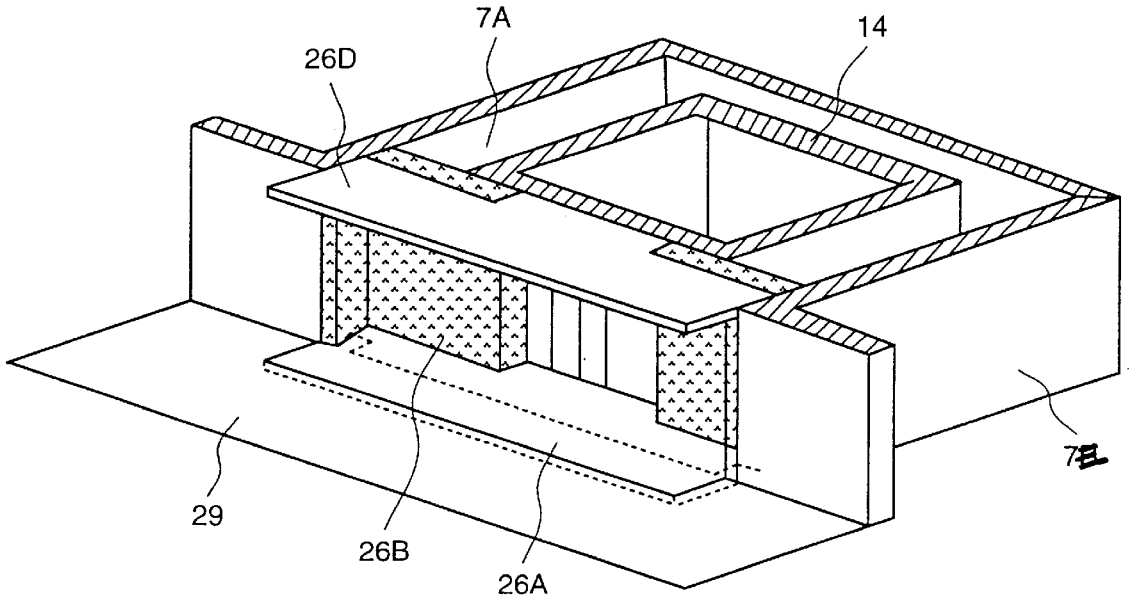
FIG. 35 is a perspective view of the structure of FIG. 33.
Figure 36:
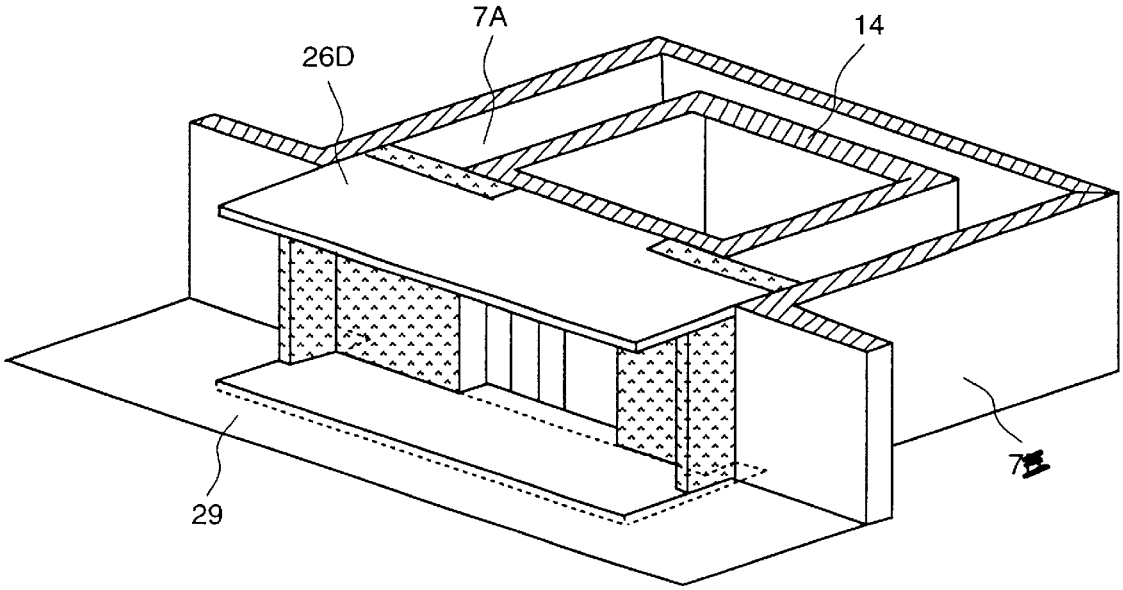
FIG. 36 is a perspective view of the structure of FIG. 34.

FIGS. 33, 34, 35 are views showing other embodiment of the present invention, in which a part 26F extending to the elevator hall is provided in parallel to the partition wall 7 in both end parts of the movable wall 26B of the building, whereby the movable wall 26 is capable of moving along the surface the partition wall 7. Furthermore, at the corners of the movable wall 26 and the part member 26F, a reinforcement material 26G is provided. As shown in FIGS. 33, 35, usually, the movable wall 26B of the building is provided at the back position beforehand so that the part member 26F does not stick out, and when an earthquake creates a motion, the part 26F moves out as shown in FIGS. 34, 36.

Next, another embodiment of the present invention will be explained with reference to FIGS. 16 to 26, wherein the building has a non-seismic isolation building portion 2, installed indirectly on the surface of the ground 1, and a seismic isolation building portion 3, installed on the non-seismic isolation building portion 2. The seismic isolation building portion 3 is mounted on plural seismic isolation devices 4 located on the non-seismic isolation building portion 2. On this account, even if the non-seismic isolation building portion 2 swings due to an earthquake, the earthquake motion of the seismic isolation building portion 3 is restrained because it is mounted on the non-seismic isolation building portion 2 through the seismic isolation devices 4.

The non-seismic isolation building portion 2 has partition walls 7 which partition the inside of the space surrounded by an outside wall 5 of the building and a floor 6, and plural spaces 8A, 8B, 8C are provided as rooms. The seismic isolation building portion 3 has inside walls 12 to form with the outside wall 9, an upper stories elevator shaft portion 11, and the floors 10 form plural spaces 13A, 13B, 13C, 13D as the plural floors of the building.

The elevator shaft 30 is divided into an upper stories shaft portion 30A and a lower stories shaft portion 30B at separated by intermediate part of the building.

When an earthquake motion occurs and a relative displacement occurs between the seismic isolation building portion 3 and the non-seismic isolation building portion 2, a relative displacement occurs between the upper stories shaft portion 30A and the lower stories shaft portion 30B.

In order to prevent sudden deformation of the guide rail 31 caused by relative displacement between the upper stories shaft portion 30A and the lower stories shaft portion 30B, a hoistway supporting framework 32 is arranged across plural stories of the non-seismic isolation building portion 2 and the seismic isolation building portion 3, and the guide rail 31 is supported with this hoistway supporting framework 32, whereby deformation of the guide rail 31 is dispersed into several stories.

Figure 18:
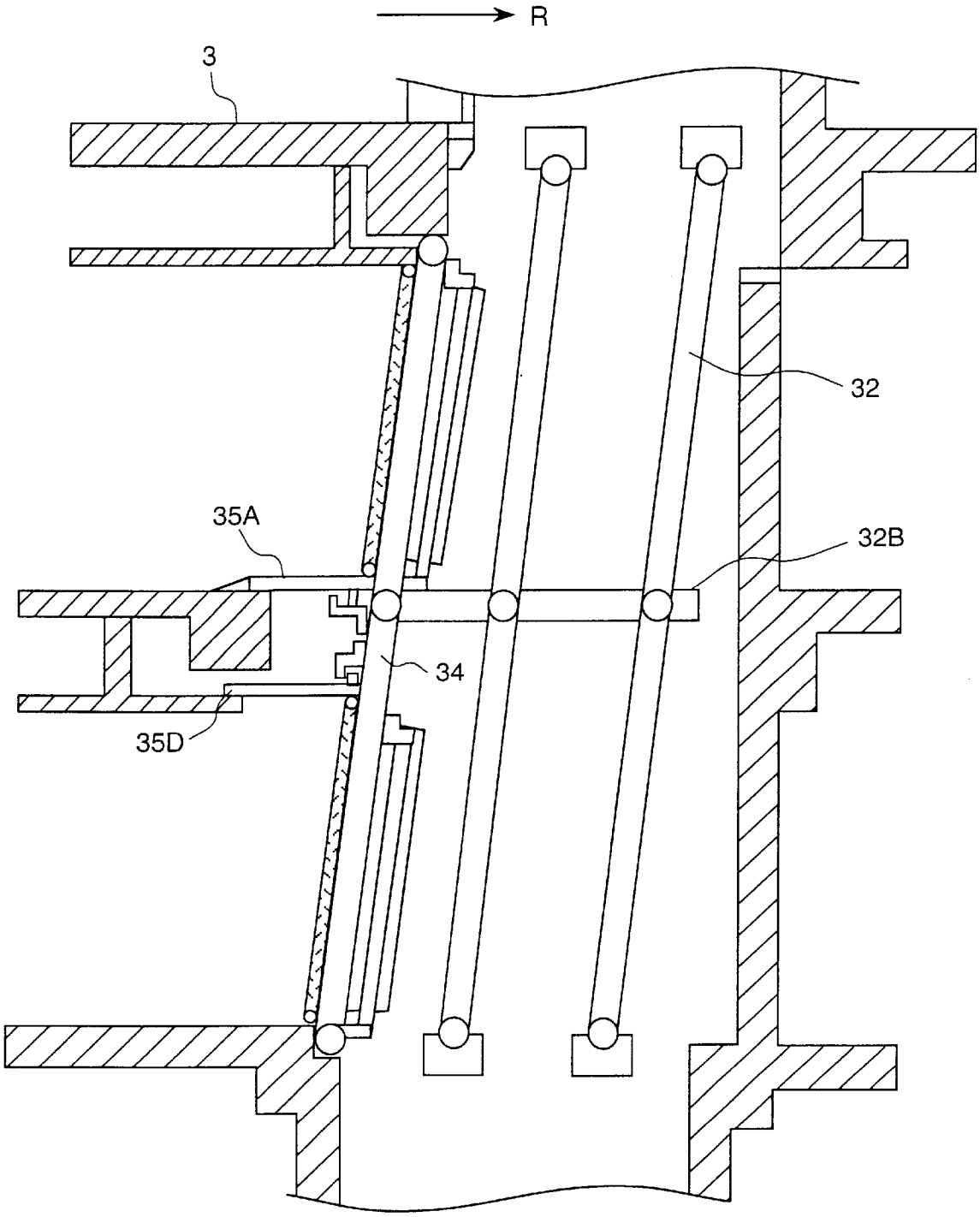
FIG. 18 is a detail longitudinal section of the elevator apparatus, showing the positional relationship when a displacement outbreaks in the front and the back directions (pattern 1) in FIG. 17.
Figure 19:
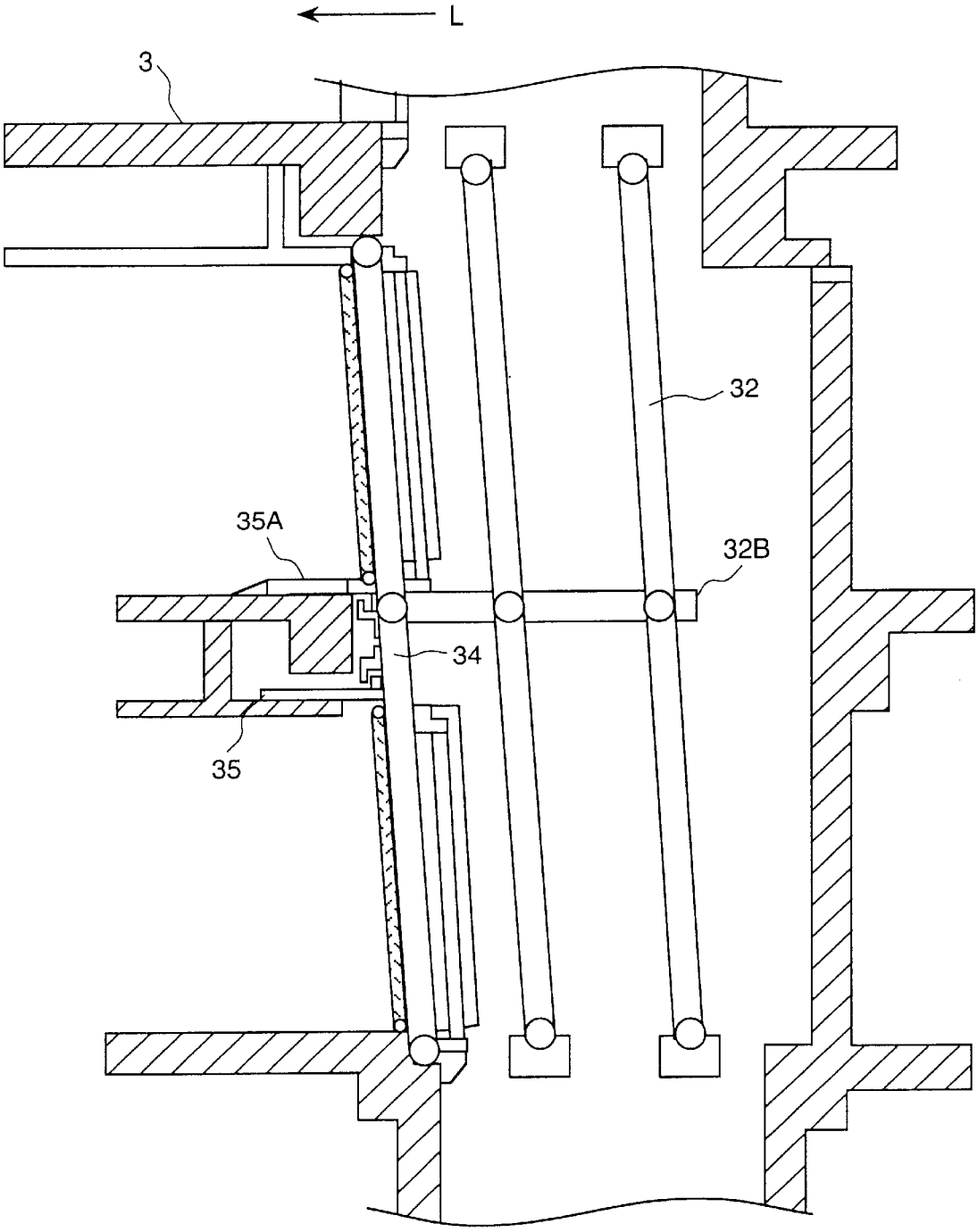
FIG. 19 is a detail longitudinal section of the elevator apparatus, showing the positional relationship when a displacement outbreaks in the front and the back directions (pattern 2) in FIG. 17.
Figure 20:
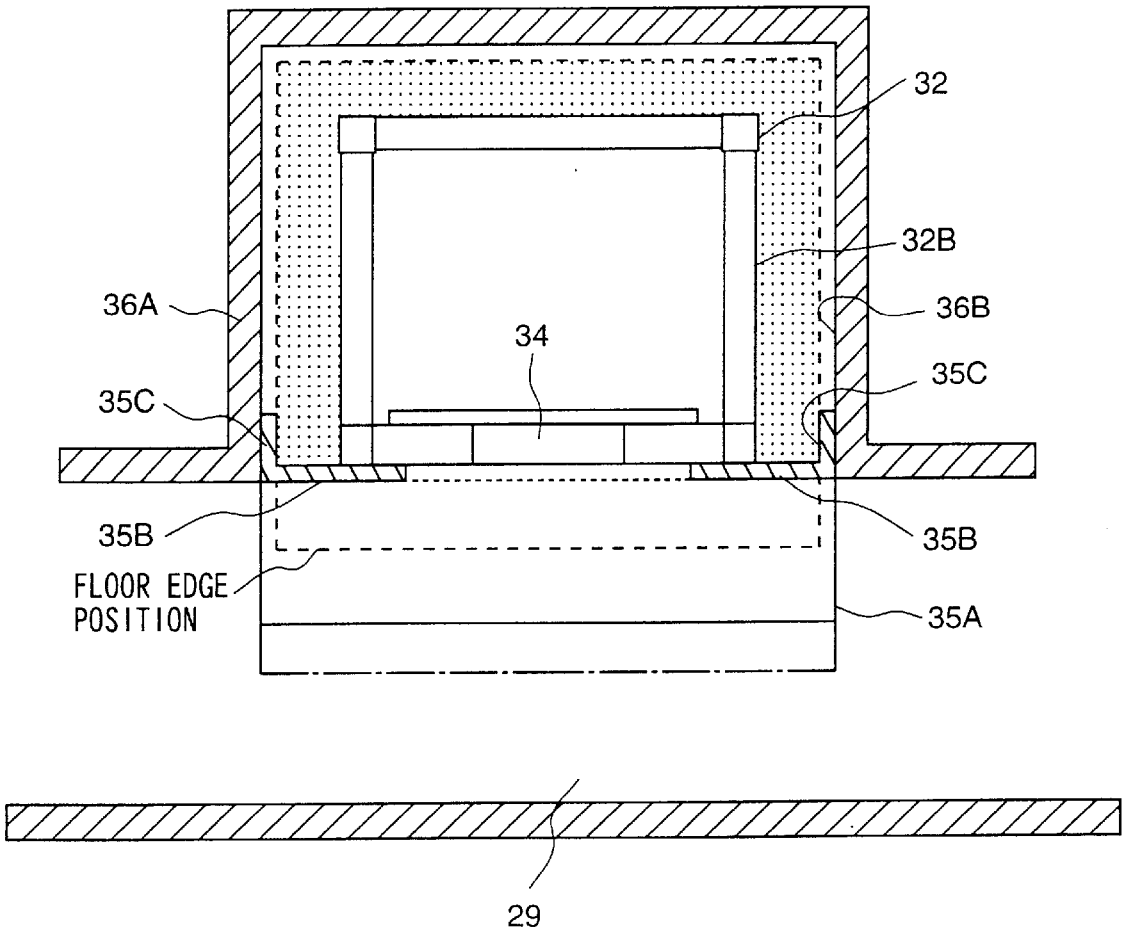
FIG. 20 is a sectional view taken along a line I—I of FIG. 17, showing a state when there is no relative displacement between the top and the bottom buildings.

This hoistway supporting framework 32 is formed with a longitudinal frame 32A and a lateral beam 32B. The upper part of the hoistway supporting framework 32 is supported on the seismic isolation building portion 3, and the lower part is supported on the non-seismic isolation building portion 2. As shown in FIG. 18 and FIG. 19, when this hoistway supporting framework 32 inclines toward the front and back, and in right and left directions, a relative displacement occurs between the non-seismic isolation building portion 2 and the seismic isolation building portion 3.

The lateral beam 32B of this hoistway supporting framework 32 is attached to the supporting framework 34, on which the door 33 is installed for getting on and off the elevator. When the hoistway supporting framework 32 inclines in the front and back directions, the supporting framework 34 is constructed to incline so as to follow that inclination.

Figure 16:
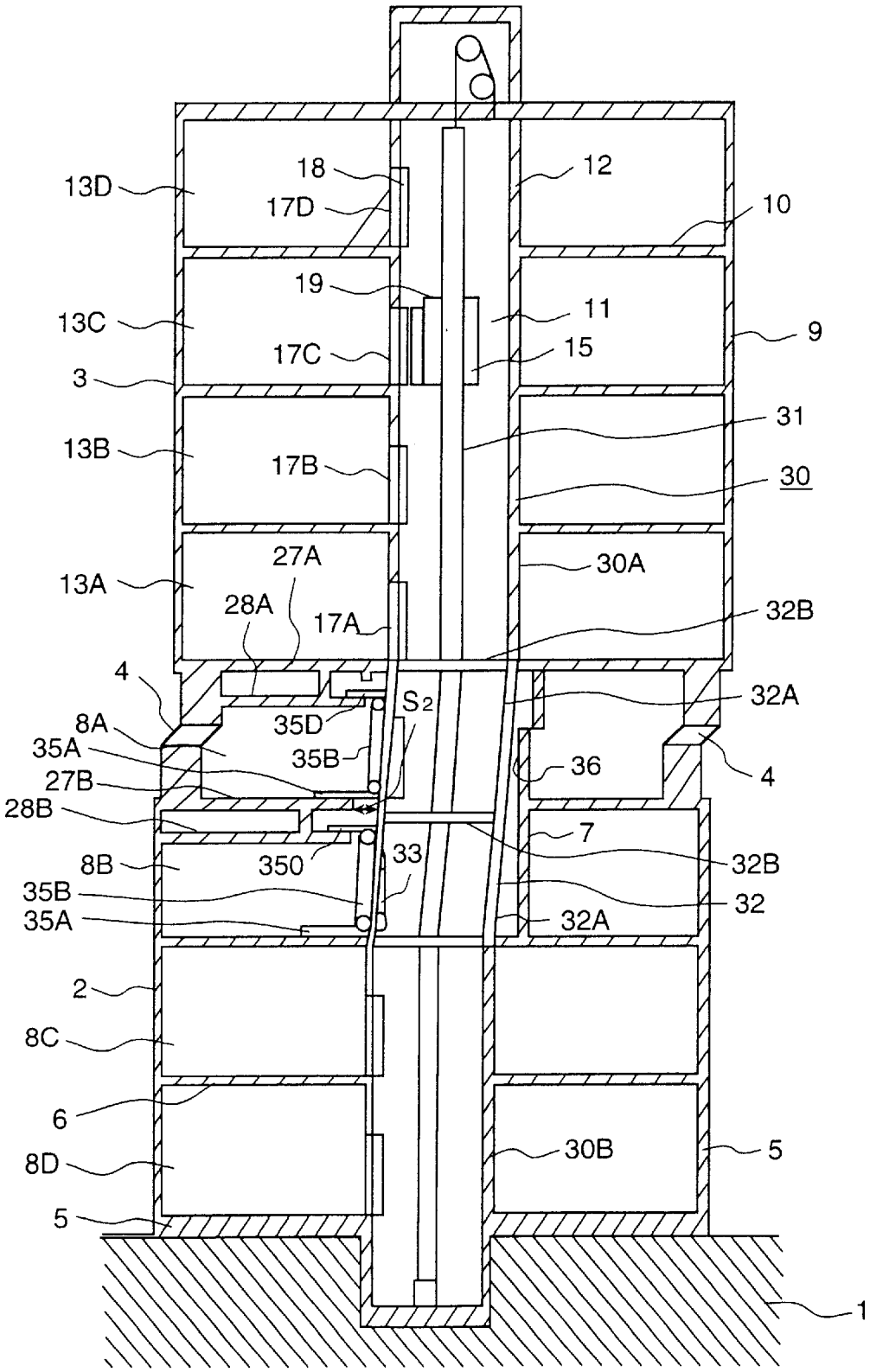
FIG. 16 is a side sectional view of the elevator apparatus showing another embodiment of the present invention.
Figure 17:
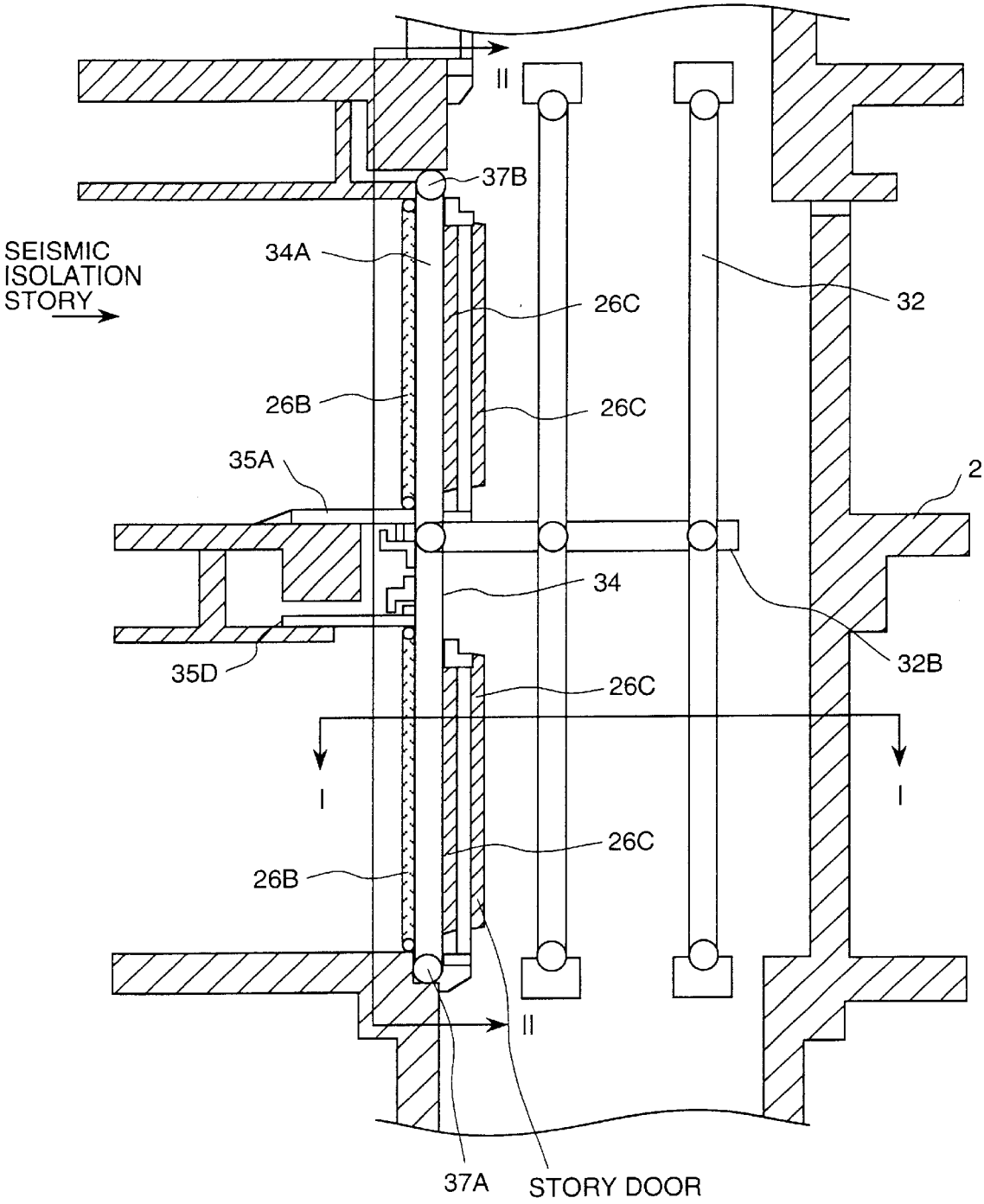
FIG. 17 is a detail longitudinal section of the non-seismic isolation building side entrance part of the stories having a hoistway supporting frame work of the elevator apparatus shown in FIG. 16, and it shows a normal state when there is no relative displacement between the top and the bottom buildings.
Figure 21:
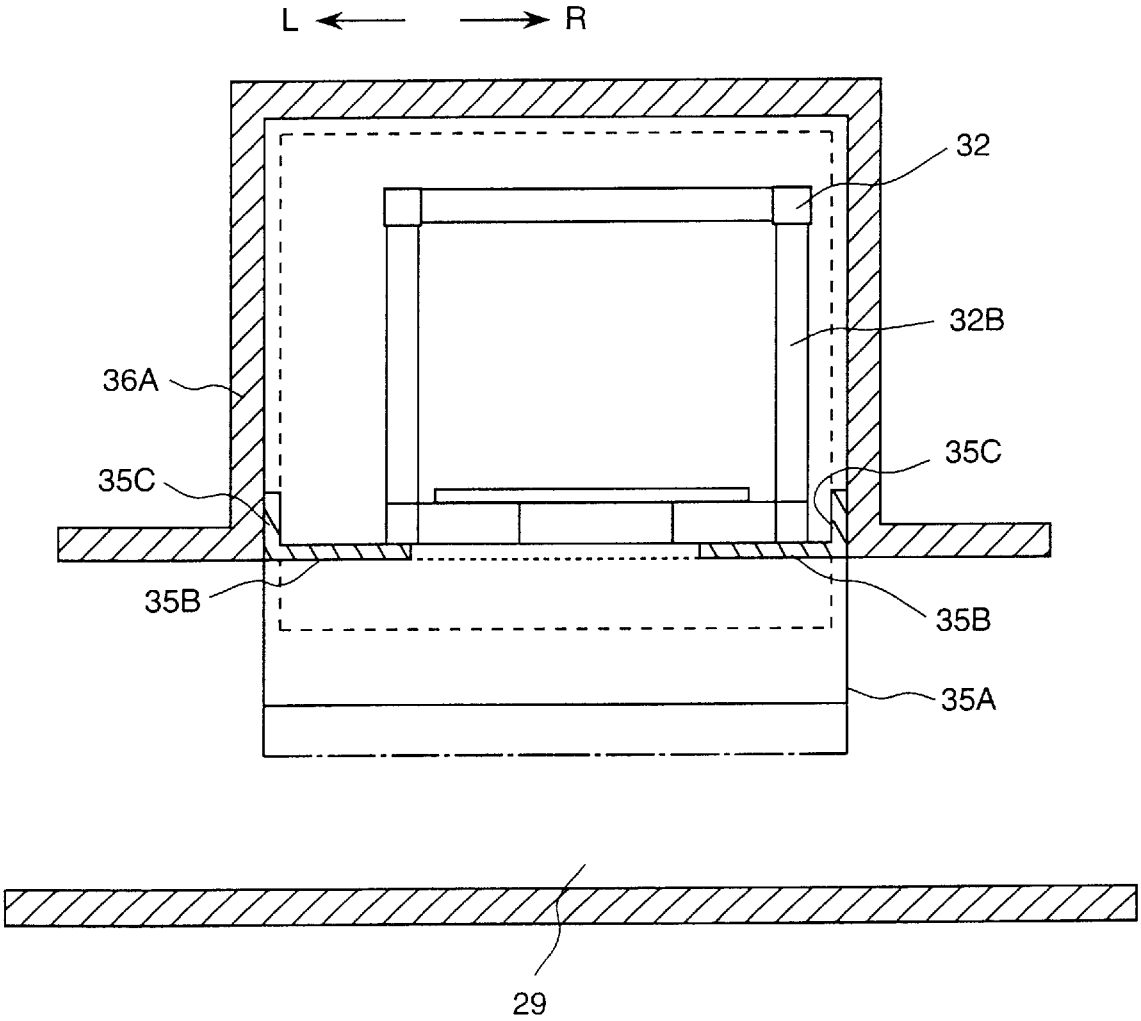
FIG. 21 is a sectional view taken along a line I—I of FIG. 17, showing a positional relationship when a displacement outbreaks in the right and the left directions (pattern 1) in FIG. 20.
Figure 22:
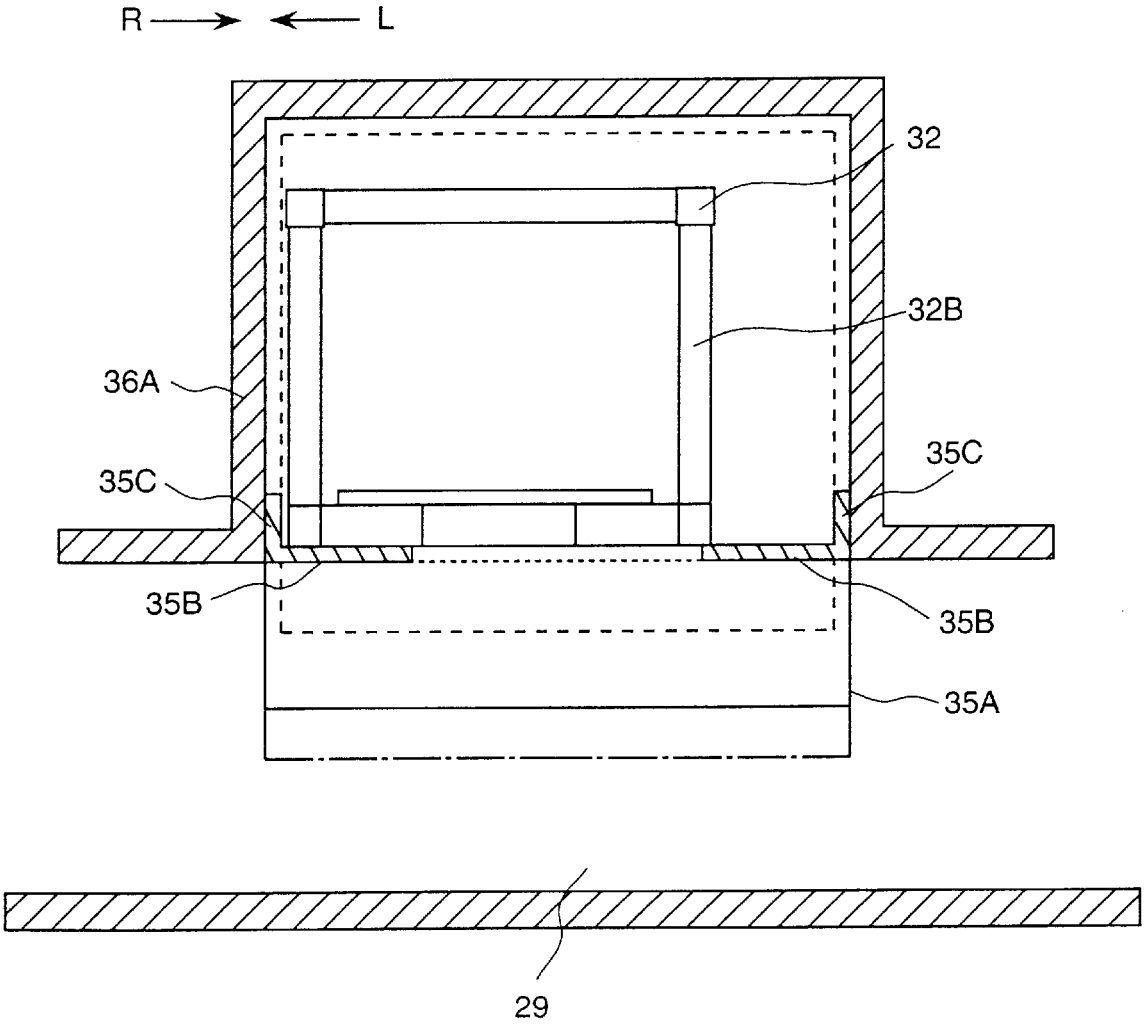
FIG. 22 is a sectional view taken along a line I—I of FIG. 17, showing a positional relationship when a displacement outbreaks in the right and the left directions (pattern 2) in FIG. 20.
Figure 23:
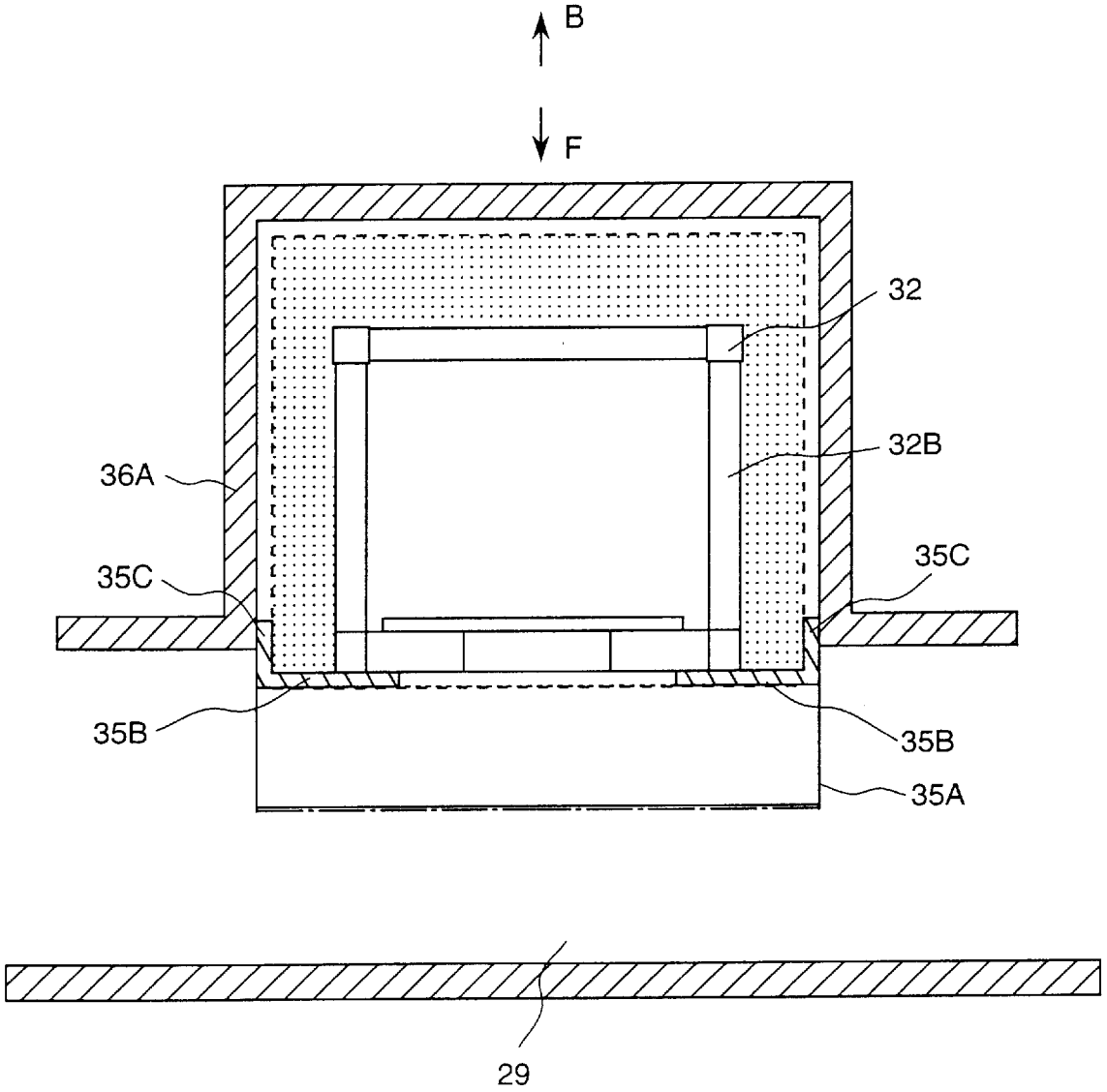
FIG. 23 is a sectional view taken along a line I—I of FIG. 17, showing a positional relationship when a displacement outbreaks in the front and the back directions (pattern 1) in FIG. 20.
Figure 24:
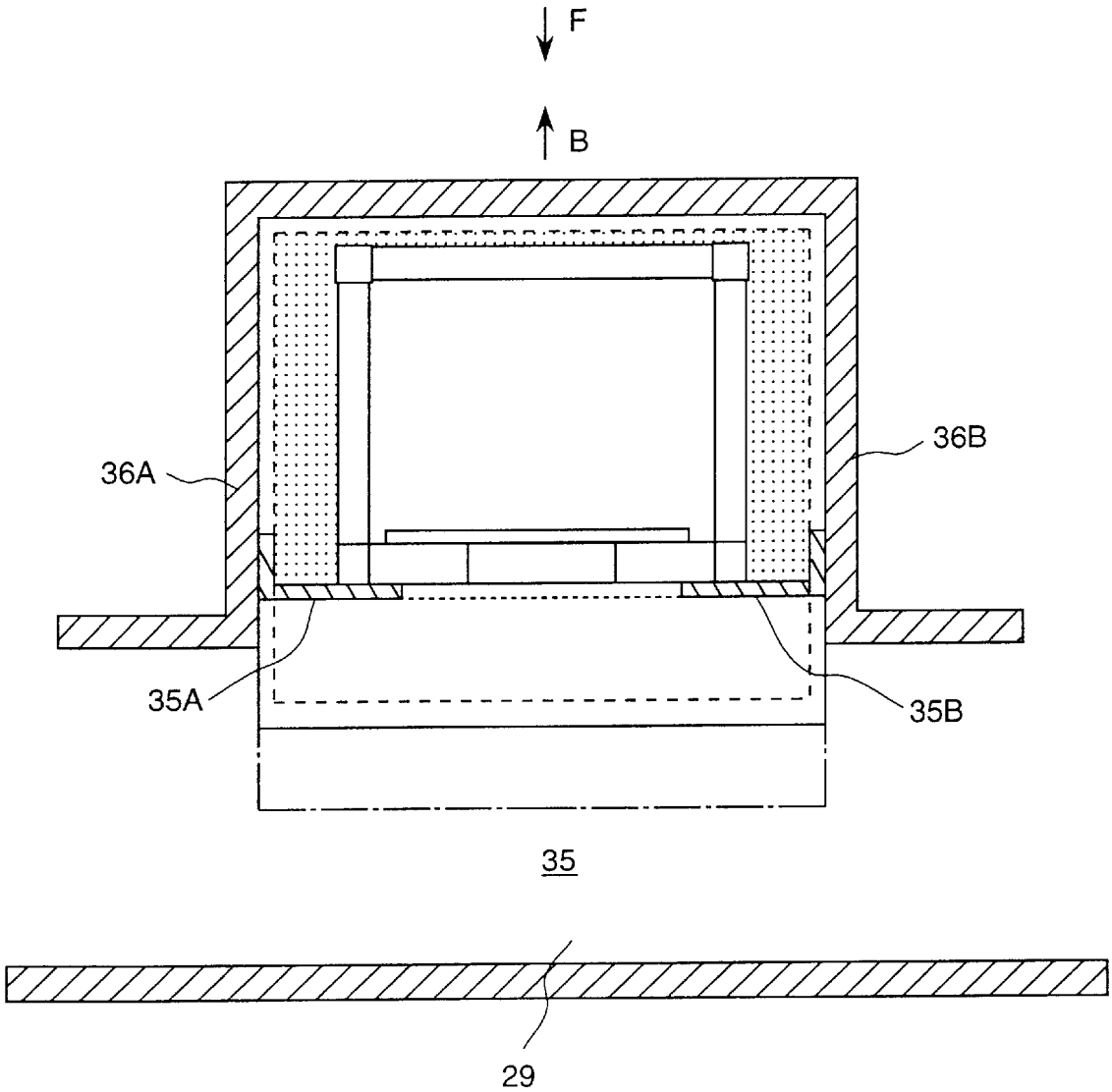
FIG. 24 is a sectional view taken along a line I—I of FIG. 17, showing a positional relationship when a displacement outbreaks in the front and the back directions (pattern 2) in FIG. 20.
Figure 25:
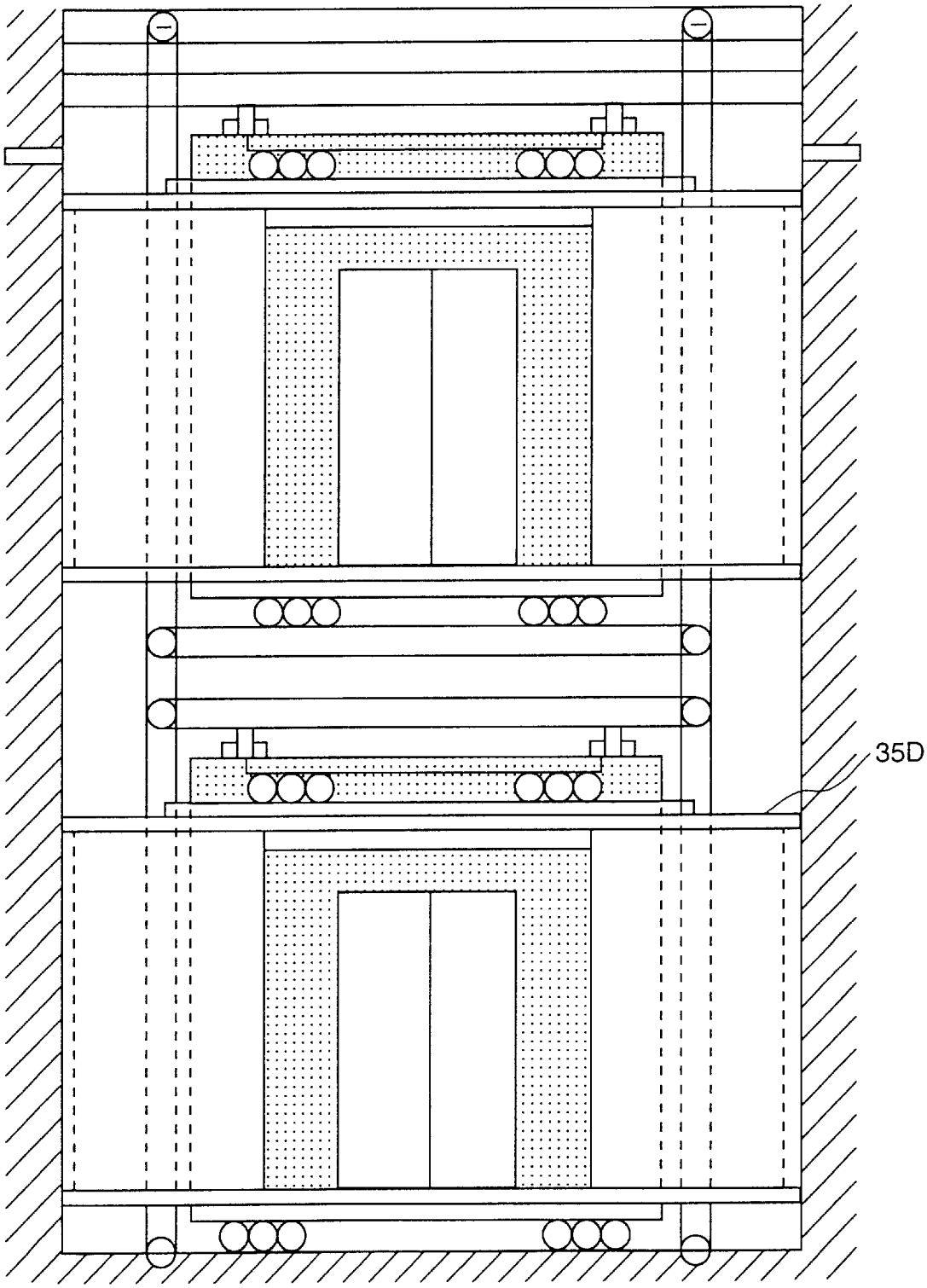
FIG. 25 is a sectional view taken along a line II—II of FIG. 17, showing a state at a normal time.
Figure 26:
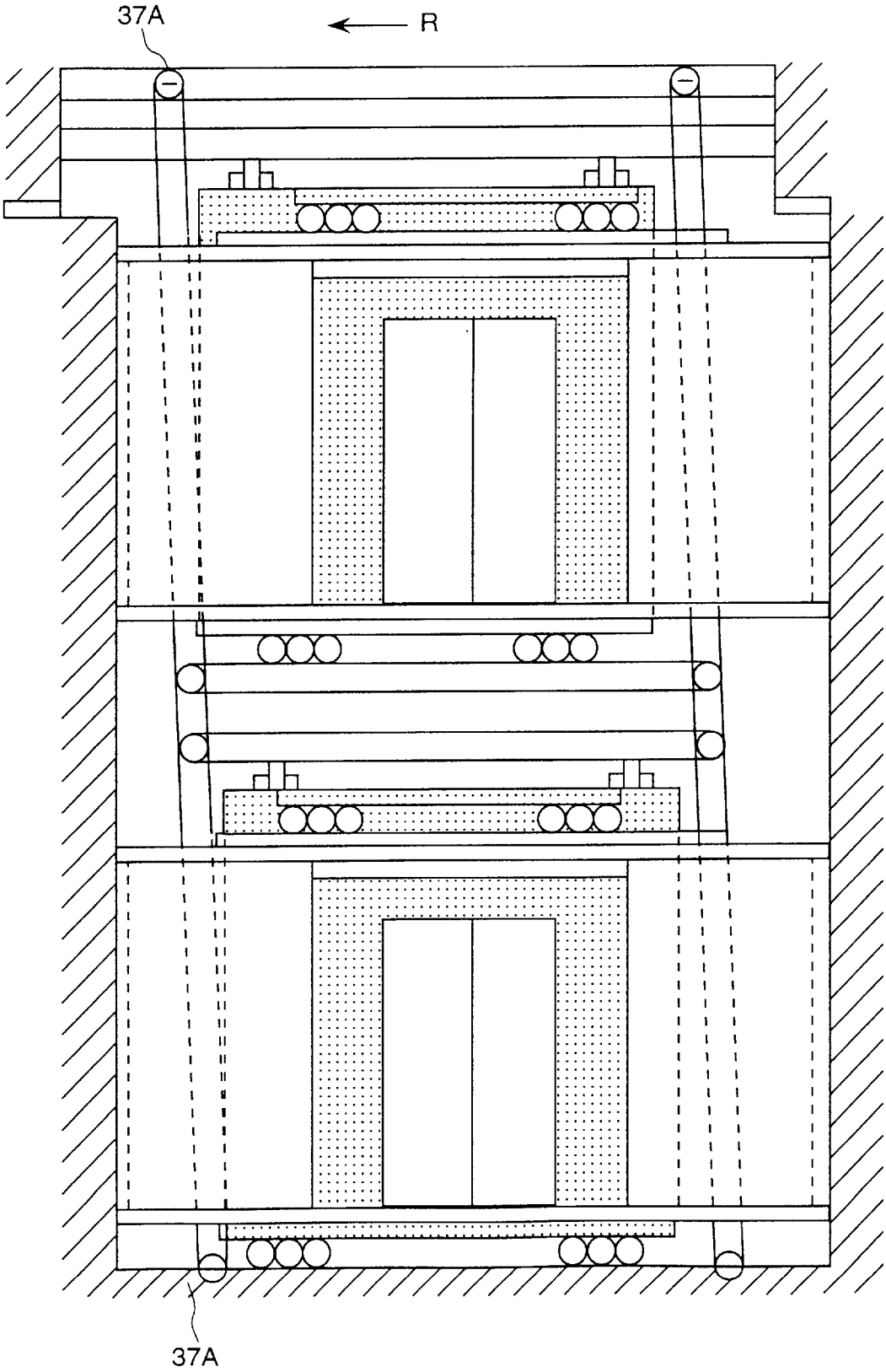
FIG. 26 is a sectional view taken along a line II—II in FIG. 17, showing a positional relationship when a displacement outbreaks in the right and the left directions (pattern 1) in FIG. 25.

On the other hand, as shown in FIG. 21 and FIG. 22, when the hoistway supporting framework 32 inclines in the right and left directions, the supporting framework 34, which is hung by a lateral beam, relatively transfers/displaces in the right and left directions. The hoistway supporting framework 32 of FIG. 16 is provided for two floors, but even it extends to other floors in addition to the two floors, it provides similar effects.

This hoistway supporting framework 32 is able to relatively displace for each building portion in any story on the non-seismic isolation building portion 2 side and the seismic isolation building portion 3 side. The clearance S2 is provided so as to permit a relative displacement between the hoistway supporting framework 32 and each building portion of non-seismic isolation building portion 2 side or seismic isolation building portion 3 side.

Since the clearance S2 is provided in the same way between the supporting framework 34 attached to the hoistway supporting framework 32 and the respective buildings portions, the expansion floor 35A is provided between the supporting framework 34 that represents a landing part of the elevator and the building structure so that a passenger can get on and off the elevator. However, since a displacement of the hoistway supporting framework 32 does not occur for the lowest one of the stories in which the hoistway supporting framework 32 of the non-seismic isolation building portion 2 side is installed, the expansion floor 35A is unnecessary.

The clearance S2 of the stories in which the hoistway supporting framework 32 is installed is partitioned off from the building structure with partition walls 36A, 36B. The expansion floor 35A extends to the partition wall 36A, 36B provided on the right and left sides facing the supporting framework 34 and closes the clearance S2 in front of the supporting framework 34. This expansion floor 35A is supported on the building structure so as to be able to move in the front and back directions of the entrance to the building.

The expansion floor 35A is supported at one end on the hoistway supporting framework 32 so as to be able to move in right and left directions relative to the supporting framework 34. In addition, the movable wall 35B of the building, which extends vertically to the ceiling is provided on the inside of the supporting framework 34 on the expansion floor 35A. This movable wall 35B extends to the partition walls 36A, 36B in the right and left directions in the same way as the expansion floor 35A, and it has a function to partition the clearance S2 from the elevator landing side of each building.

A movable side wall 35C to be mentioned later is provided as a side surface of the movable wall 35B facing the partition walls 36A, 36B provided in the right and left directions. The movable wall 35B of the building is supported by a rotation pin 37A, which allows it to incline so as to follow movement of the supporting framework 34 facing the elevator hall 29, so as to be inclined in the front and back directions relative to the expansion floor 35A.

On the upper part of this movable wall 35B, in order to close the clearance S2 in the same way as the expansion floor 35A, a slidable ceiling 35D extends to the partition wall 36A, 36B in the right and left directions. This slidable ceiling 35D is supported with the rotation pin 37B so that the movable wall 35B can incline in the front and back directions in the same way as the expansion floor 35A. The slidable ceiling rests on one end on an upper part of the suspended ceiling 28A, 28B below the ceiling 27A, 27B of the room 8A, 8B of each story, however, it may be provided on a bottom of the ceiling 28A, 28B as well. However, in that case, a construction to prevent the slidable ceiling 35D from hanging down must be provided.

The expansion floor 35A, the slidable ceiling 35D, and the movable wall 35B of the building may each be separately supported on the supporting framework 34 or the hoistway supporting framework 32. However, in that case, in the right and left directions, these parts must be supported so as to be mobile for the supporting framework 34 and the hoistway supporting framework 32.

The expansion member 35 is formed by the expansion floor 35A, the movable wall 35B and slidable ceiling 35D, and this expansion member 35 is movable in front and back directions relative to each building portion by using the partition walls 36A, 36B as a guide. In addition, the expansion member 35 may be movable in the right and left directions relative to the supporting framework 34 and the hoistway supporting framework 32. When a relative displacement has occurred in the non-seismic isolation building portion 2 and the seismic isolation building portion 3 by an earthquake, the displacement can occur in front and back, and right and left directions.

A side surface of the partition walls 36A, 36B in right and left sides of each building portion facing the elevator hall 29 is arranged to be coextensive with a surface of the movable wall 35B facing the elevator hall 29, and when the expansion member 35 moves to the front in each building portion in response to an earthquake, the movable wall 35B moves out to the front beyond the surface of the partition walls 36A, 36B facing the elevator hall 29.

When the movable wall 35B moves out, the side thereof along the partition walls 36A, 36B can be seen from the elevator hall 29. Because the movable wall 35B does not have a sufficient thickness, the clearance S2 can be partitioned off each building portion by blocking it up with the movable side wall 35C, even if the relative displacement exceeds the thickness of the movable wall 35B.

The movable side wall 35C performs the role of a guide when an expansion member swings to return to a previous position. In addition, when the expansion member 35 moves backward, the movable wall 35B of the building goes back beyond the surface of the partition wall 36A, 36B facing the elevator hall 29, and so there becomes insufficient room for the relative displacement between the non-seismic isolation building portion 2 and the seismic isolation building portion 3, and the movable wall 35B of the building is moved back to the position of the face of the partition walls 36A, 36B facing the elevator hall 29.

The partition walls 36A, 36B facing the elevator hall 29 may be arranged to extend out in the front direction always to an extent corresponding to the amount that the movable wall of the building 35B moves out. In that case, the surface of movable wall 35B of the building does not move out beyond the surface of the partition walls 36A, 36B facing the elevator hall 29, in which case the movable side wall 35C does not need to be provided.

As the surface of the partition walls 36A, 36B facing the elevator hall 29 is not provided beyond the side surface of the movable wall 35B facing the elevator hall 29, the space for the passage that is necessary for an elevator landing part of each building portion 2 becomes small. In this embodiment, if the supporting framework 34 is not supported on the hoistway supporting framework 32, a construction can be employed in which the supporting framework 34 links to the hoistway supporting framework 32 by using another mechanism.

As explained above, in an elevator system having an elevator shaft which is provided in a seismic isolation building portion and which extends up and down therein, and a lower stories shaft structure which is located in a non-seismic isolation building portion, disposed beneath the seismic isolation building portion, and has a lower stories shaft in communication with the upper elevator shaft, the partition wall on the entrance side is removed, and a movable wall of the building is provided in the lower stories shaft side. With this construction, a necessary space for the non-seismic isolation building entrance part becomes only equal to the thickness of the movable wall of the building by partitioning off the clearance provided to accommodate earthquake motion, so that the space can be reduced conventional arrangement.

Moreover, in an elevator system having an elevator shaft which is provided in the seismic isolation building portion and which extends up and down therein, a frame for supporting a rail at a seismic isolation story, and a frame to support an entrance door hung from a lateral beam of the frame, a necessary space of the entrance part of the frame installation for supporting the rail becomes to have only the thickness of the movable wall of the building, and can be reduced compared to that a conventional construction, by removing the partition with the elevator shaft of the entrance side so as to provide a movable wall of the building on a frame for supporting a rail, and to partition off the elevator shaft.

Figure 31:
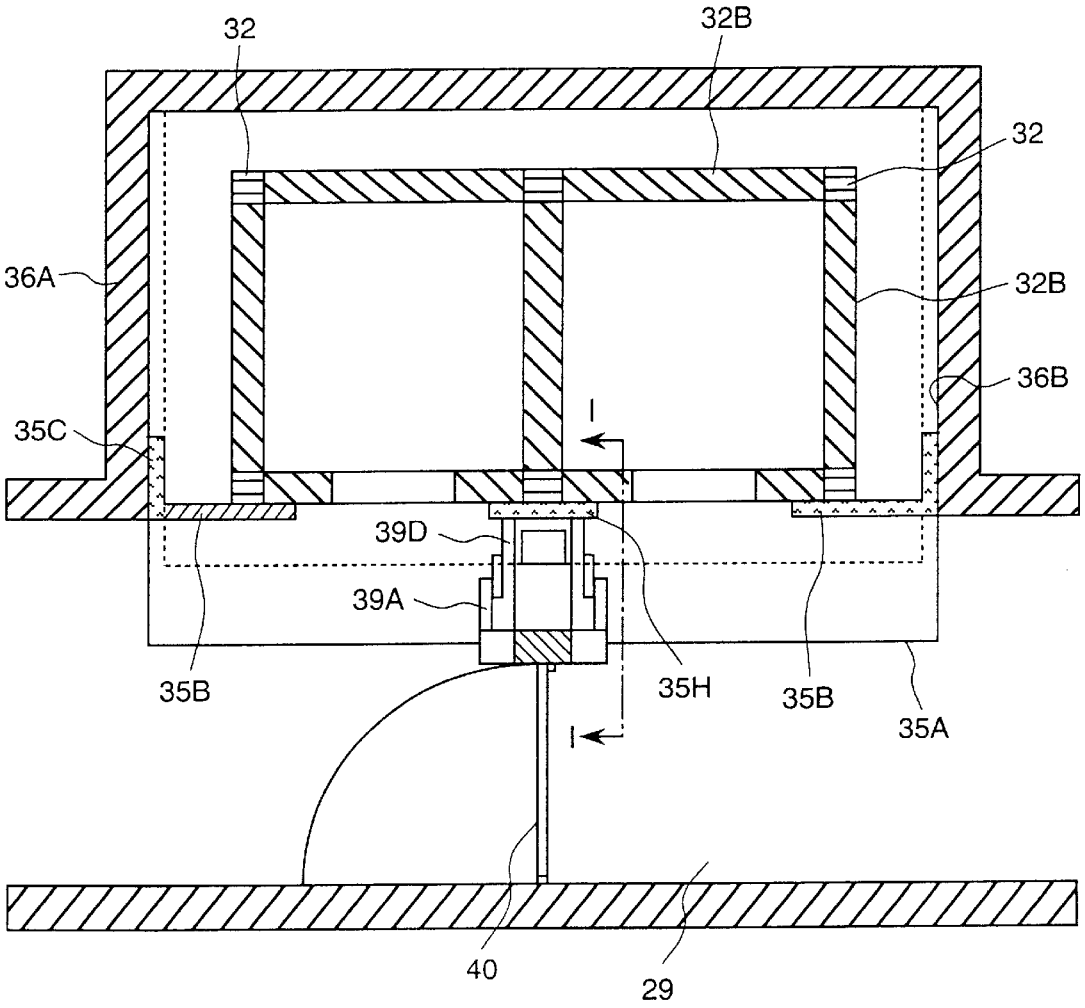
FIG. 31 is a sectional view showing a constitution applied according to the present invention to a juxtaposition elevator.
Figure 32A:
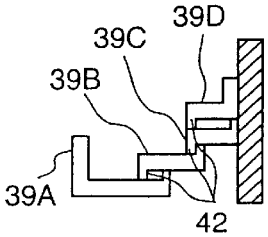
FIGS. 32(A), 32(B) and 32(C) are cross-sectional views and FIGS. 32(A'), 32(B') and 32(C') are corresponding longitudinal sectional views showing a constitution applied according to the present invention to a juxtaposition elevator.
Figure 32:
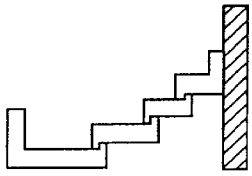
Figure 32C:
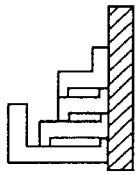
Figure 32C:
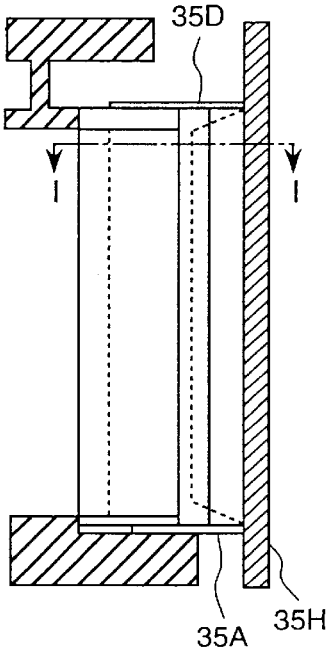
Figure 32C:
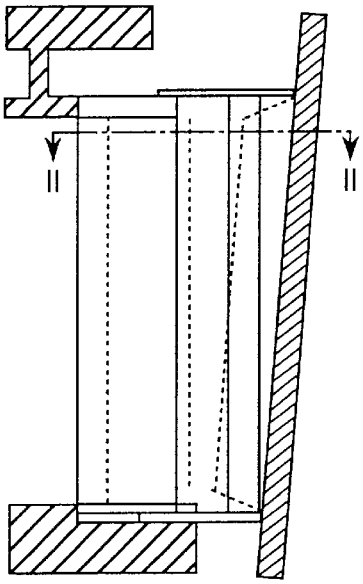
Figure 32C:
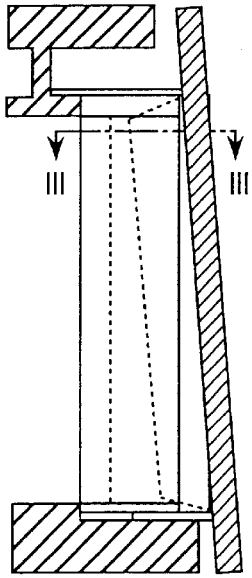

FIG. 31 is a sectional view showing another embodiment of the present invention, and an additional elevator guide rail 31 is supported between shaft portions 30A, 30B of the non-seismic isolation building portion 2 and the seismic isolation building portion 3, and an additional elevator is provided in the same manner as in FIG. 16. In the same way as an individual elevator, a movable wall 35B is installed in an entrance side of a lower stories elevator shaft along with an expansion floor 35A, which moves in front and back directions using the partition walls 36A, 36B as a guide, located in from side to side of said non-seismic isolation building portion. With such a construction, the elevator hall 29 is partitioned off with a clearance S being provided between the non-seismic isolation building portion 2 and the seismic isolation building portion 3. A movable wall 35H of the building may be provided on an expansion floor 35A at the entrance side of the lower stories elevator shaft between the elevators. A central movable wall 35 H of the building and the expansion floor 35A can be moved in front and back directions together, so that the displacement by an earthquake motion of the building will be absorbed, because it inclines.

In a construction in which the lower stories elevator shaft portion 14 of the non-seismic isolation building portion is an extension of the elevator shaft in the seismic isolation building portion 3 installed thereon, as in FIG. 1, when plural elevators are added, such a modification is obtained by only changing the hoistway supporting framework 32 shown in FIG. 31 into a shaft structure 12B of the shaft portion 14. When plural elevators are added, and the elevator hall 29 has to be partitioned off to provide individual right and left sides with a door or shutter 40, a side wall 39A is fixed to a rigid wall 40 of the building. In addition, the side wall 39D is supported so as to be able to slide up and down along the movable wall 35H of the building, and when the movable wall 35H of the building inclines, the wall 39D inclines so as to follow it. When the side wall 39 is inclined, a notch part is provided so as to prevent it from hitting the expansion floor 35A or the ceiling 35D. When there is no expansion floor or ceiling at the top and bottom of the side wall 39D, the notch is unnecessary.

The side walls 39B, 39C have a construction such that they can be moved backward (a depth direction) laterally, and the side wall 39C is moved to the movable wall side usually and the clearance of a notch under or over the side wall 39D is closed. A stopper 42 is arranged on each side wall, so that even if the movable wall 35H is displaced in the direction in which the side wall spreads, the displacement is limited by the stoppers.

When the movable wall 35H inclines in the direction where the side wall spreads, the side wall 39D inclines too and the clearance of a notch of the lower part opens, however it is closed because there is the side wall 39C. When the side wall is displaced in a direction to spread, the side wall 39C is caught on the stopper 42 of the side wall 39D, and it is pulled out from the side wall 39B. When the side wall 39C is pulled out to a limit from the side wall 39B, the side wall 39B is caught on the stopper 42 of the side wall 39C and is pulled out from said side wall 39A. When the side wall inclines in a direction to be shortened, on the other hand, the side wall 39C inclines as well, and the clearance of the upper notch spreads, however it is closed because of the presence of the side wall 39C. When the side wall is displaced in a direction to be shortened, the side wall 39C hits the movable wall 35H, is pushed into the side wall 39B side; and, if it is changed further, the side wall 39B hits the movable wall 35H, and is pushed into the side wall 39A.

Such a side wall is installed in the rigid wall of the building, the elevator hall on the right and left side can be divided by closing the clearance between the rigid wall 40 and the wall of another side of the hole 29 with the door or the shutter 40.

When it is always divided, the clearance between the rigid wall 40 and the other side wall of the hole may be completely closed with the wall fixed to the building. In addition, there is no need to provide the side wall 39B between the side walls 39C and 39A. In addition, it may be constituted with side walls of similar construction formed of plural pieces.

According to the present invention as described above, the space for the elevator platform entrance can be made larger.

What is claimed is:

1. An elevator apparatus including a non-seismic isolation building having at least one story, a seismic isolation building installed through seismic isolation means on said non-seismic isolation building, an elevator shaft structure being extended to a top and bottom direction in said non-seismic isolation building and said seismic isolation building and having a clearance for said non-seismic isolation building so as to be able to relatively transfer/displace a car that moves to said top and bottom direction along an elevator shaft formed by said elevator shaft structure, an elevator shaft side landing part formed on said elevator shaft structure, an expansion floor provided at said clearance between a landing part of said non-seismic isolation building and said elevator shaft landing part, said elevator apparatus characterized by comprising a movable wall provided between partition members located on said non-seismic isolation building and said elevator shaft structure, being capable to relatively transfer/displace with said partition members when said non-seismic isolation building is swung in right and left directions, and being capable to relatively transfer/displace with said elevator shaft structure when said non-seismic isolation building is swung in front and back directions.

2. An elevator apparatus as defined in claim 1, wherein respective edges of said partition members facing an elevator hall are located to said back direction against said elevator hall from an edge of a floor of said non-seismic isolation building.

3. An elevator apparatus including a non-seismic isolation building having at least one story, a seismic isolation building having at least one story and an upper stories shaft portion extending to a top and bottom direction and being installed through a seismic isolation means on said non-seismic isolation building, a lower stories shaft structure having a lower stories shaft portion which is supported by said seismic isolation building, is extended to said top and bottom direction in said non-seismic isolation building, and is communicated to said upper stories elevator shaft portion, a car that is movable to said top and bottom direction along said upper and lower stories elevator shaft, a lower stories elevator shaft side landing part provided on said lower stories shaft structure, a non-seismic isolation building side landing part installed on said non-seismic isolation building facing said lower stories elevator shaft side landing part, and an expansion floor provided between said non-seismic isolation building and said lower stories elevator shaft side landing part, said elevator apparatus characterized by comprising a movable wall being provided between partition members which is located on right and left sides of said landing part of said non-seismic isolation building, being capable to relatively transfer/displace with said partition members when non-seismic isolation building is swung to right and left directions, and being capable to relatively transfer/displace with said lower stories elevator shaft structure when said non-seismic isolation building is swung in front and back directions.

4. An elevator apparatus as defined in claim 3, wherein respective edges of said partition members facing an elevator hall are located to said back direction against said elevator hall from an edge of a floor of said non-seismic isolation building.

5. An elevator apparatus including a non-seismic isolation building having at least one story, a seismic isolation building having plural floor stories and an upper stories elevator shaft portion extending to a top and bottom direction and being installed through a seismic isolation means on said non-seismic isolation building, a lower stories shaft portion which is installed on said non-seismic isolation building and is connected to said upper stories elevator shaft portion, a guide rail which is provided across said non-seismic isolation building and said seismic isolation building, a hoistway supporting frame work which is provided across said non-seismic isolation building and said seismic isolation building, and a frame for a floor story door installed in said hoistway supporting frame work, said elevator apparatus characterized by comprising a movable wall provided between partition members which are located on right and left sides of said landing part of said non-seismic isolation building or said seismic isolation building, being capable to move with said partition members when said non-seismic isolation building is swung in right and left directions, and being capable to relatively transfer/displace with said hoistway supporting frame work when said lower stories elevator shaft structure is swung in front and back directions.

6. An elevator apparatus as defined in claim 5, wherein respective edges of said partition members facing an elevator hall are located to said back direction against said elevator hall from an edge of a floor of said non-seismic isolation building.

7. An elevator apparatus including a non-seismic isolation building having at least one story, a seismic isolation building installed through seismic isolation means on said non-seismic isolation building, an elevator shaft structure being extended to a top and bottom direction in said non-seismic isolation building and said seismic isolation building and having a clearance with said seismic isolation building so as to be able to relatively transfer/displace to said seismic isolation building, a car that moves to said top and bottom direction along an elevator shaft formed by said elevator shaft structure, an elevator shaft side landing part formed on said elevator shaft structure, and an expansion floor provided at said clearance between a landing part of said seismic isolation building and said elevator shaft landing part, said elevator apparatus characterized by comprising a movable wall provided between partition members located on said non-seismic isolation building and said elevator shaft structure, being capable to relatively transfer/displace with said partition members when said non-seismic isolation building is swung in right and left directions, and being capable to relatively transfer/displace with said elevator shaft structure when said non-seismic isolation building is swung in front and back directions.

8. An elevator apparatus as defined in claim 7, wherein respective edges of said partition members facing an elevator hall are located to said back direction against said elevator hall from an edge of a floor of said non-seismic isolation building.

9. An elevator apparatus as defined in one of claims 1, 3, 5, and 7 further comprising an expansion floor which is movable to right and left and front and back directions with said movable wall, and extends to said partition members in said right and left sides.

10. An elevator apparatus as defined in one of claims 1, 3, 5, and 7 further comprising a slidable ceiling which is movable to right and left and front and back directions with said movable wall, and blocks up said clearance extending to said partition members.

11. An elevator apparatus as defined in one of claims 1, 3, 5, and 7 wherein said movable wall is located in a position which retreated a predetermined distance from said elevator hall edge part of said partition members at a usual time when earth quake motion does not occur, and said movable wall did not stick out from said partition member even if the greatest earth quake motion occurs.

12. An elevator apparatus as defined in one of claims 1, 3, 5, and 7 wherein said edge of said partition members of said movable wall extends in parallel to a direction within a face of said partition members.

* * * * *